US006479221B1

(12) United States Patent
Ishigaki et al.

(10) Patent No.: US 6,479,221 B1
(45) Date of Patent: Nov. 12, 2002

(54) HEAT-DEVELOPABLE IMAGE-RECORDING MATERIAL AND METHOD OF DEVELOPING THE SAME

(75) Inventors: Kunio Ishigaki, Minami-ashigara (JP); Toshiaki Kubo, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/408,564

(22) Filed: Sep. 30, 1999

(30) Foreign Application Priority Data

Sep. 30, 1998 (JP) ..... 10-292868
Nov. 19, 1998 (JP) ..... 10-346561

(51) Int. Cl.[7] ..... G03C 5/16

(52) U.S. Cl. ..... 430/350; 430/348; 430/619; 355/30; 396/575

(58) Field of Search ..... 430/619, 523, 430/531, 264, 350, 348; 219/216; 390/575; 355/30

(56) References Cited

U.S. PATENT DOCUMENTS 3,629,549 A 12/1971 Svendsen
4,518,845 A 5/1985 Svendsen
5,558,983 A * 9/1996 Simpson et al. ..... 430/619
5,635,339 A * 6/1997 Murray ..... 430/350
5,705,324 A * 1/1998 Murray ..... 430/350
5,750,328 A * 5/1998 Melpolder et al. ..... 430/619
5,874,191 A * 2/1999 Anderson et al. ..... 430/41
6,007,971 A * 12/1999 Star et al. ..... 430/350
6,060,228 A * 5/2000 Suzuki ..... 430/522

FOREIGN PATENT DOCUMENTS

WO WO 9713181 A1 4/1997

* cited by examiner

*Primary Examiner*—Thoral Chea
(74) *Attorney, Agent, or Firm*—Birch, Stewart, Kolasch & Birch, LLP.

(57) ABSTRACT

Desclosed is a heat-developable image-recording material including a support on which are formed at least one image-forming layer and at least one protecting layer formed on top of said image-forming layer, the heat-developable image-recording material being developed by use of a heat development apparatus comprising a roller coming into a driving contact with a surface of the material on the side having the image-forming layer, the apparatus comprising a smooth surface coming into a sliding contact for transport with a surface of the material opposite to the surface on the side having the image-forming layer, wherein at the temperature where the development is carried out, the ratio is 1.5 or more of the coefficient of friction between the surface on the side having the image-forming layer and a surface of the roller of the heat development apparatus, to the coefficient of friction between the surface opposite to the surface on the side having the image-forming layer and the smooth surface of the heat development apparatus. The heat-developable image-recording material according to the present invention has a good transportability during heat development, does not cause any uneven treatment, and has excellent heat development properties.

1 Claim, 1 Drawing Sheet

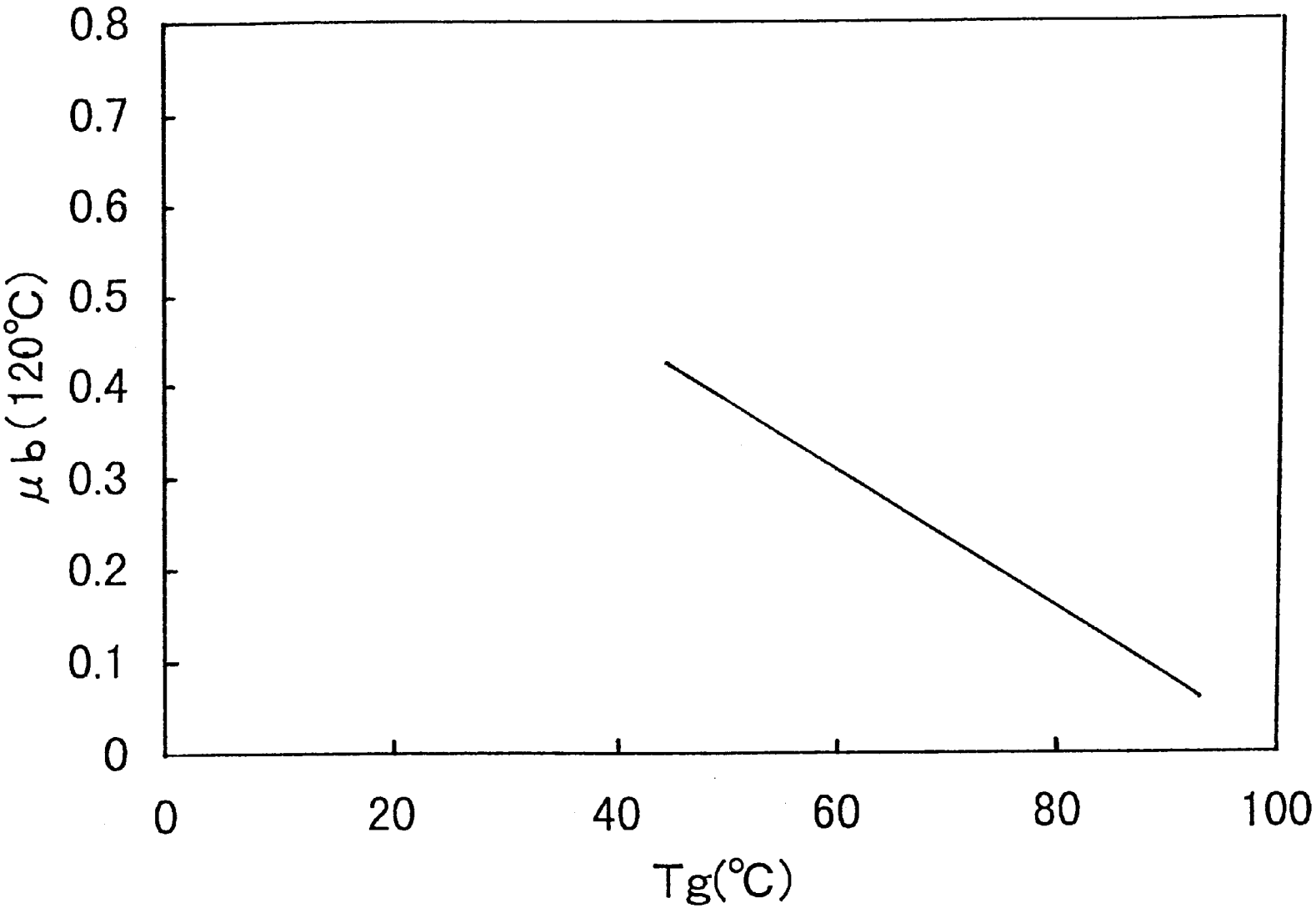
0.8
0.7
0.6
0.5
0.4
0.3
0.2
0.1
0
μb (120°C)
0
20
40
60
80
100
Tg(°C)

HEAT-DEVELOPABLE IMAGE-RECORDING MATERIAL AND METHOD OF DEVELOPING THE SAME

FIELD OF THE INVENTION

The present invention relates generally to a heat-developable image-recording material and a method of developing the same, and more particularly to a heat-developable image-recording material for photolithographic coatings, which gives high-contrast photographs and has excellent heat development properties and to a method for developing the same.

BACKGROUND OF THE INVENTION

As one of the light exposure methods of photographic photosensitive materials, there has been known a method for image formation of so-called scanner type, wherein an original is scanned, and a silver halide photographic material is light-exposed based on the obtained image signals to form a negative or positive image corresponding to the image on the original.

As for a case where an image output from a scanner on a film is further printed directly on a printing plate without reversal step, or a scanner light source having a soft beam profile, a photosensitive material for scanners exhibiting ultra-high contrast property has been desired.

A large number of photosensitive materials comprising a support having thereon a photosensitive layer are known, where the image formation is performed by imagewise exposing the photosensitive material. Of these, a technique of forming an image by heat development is a system capable of satisfying the issue of environmental protection or simplifying the image formation means.

In recent years, reduction of the amount of waste processing solutions is keenly demanded in the field of photomechanical processes from the standpoint of environmental protection and space savings. To cope with this, techniques are required to produce heat-developable photosensitive materials for use in photomechanical processes, which can be effectively exposed by a laser scanner or laser image setter and can form a clear black image having high resolution and sharpness. Such heat-developable photosensitive materials can provide to users a heat development processing system being dispensable with use of solution-type processing chemicals, simple and freed from incurring environmental destruction.

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The photosensitive material used contains a photo-insensitive silver source (e.g., organic silver salt) capable of reduction, a photocatalyst (e.g., silver halide) in a catalytic activity amount, and a reducing agent for silver, which are usually dispersed in an organic binder matrix. This photosensitive material is stable at room temperature. However, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

Although heat-developable photosensitive materials of this type have hitherto been known, most of those photosensitive materials utilize a coating with a coating liquid containing as its solvent an organic solvent such as toluene, methylethylketone (MEK) and methanol in order to form a photosenstive layer thereon. Use of the organic solvent as the solvent is disadvantageous not only in terms of adverse effects on human bodies but also in view of costs for the recovery of the solvent or the like.

Thus, the following methods have been conceived in which a photosensitive layer (a term "aqueous photosensitive layer" may also be usedhereafter) is formed using aqueous coating liquid which does not have the above-mentioned problems: For example, in JP-A-49-52626 and JP-A-53-116144, methods are described in which gelatin is used as a binder. In JP-A-50-151138, a method is described in which polyvinyl alcohol is used as a binder.

In JP-A-60-61747, a method using both gelatin and polyvinyl alcohol is described. In WO97/04355, a method is described in which a water-soluble or water-dispersed binder is used as the image-forming layer, and a water-soluble binder such as gelatin, polyvinyl alcohol, and cellulose derivative is used as a protecting layer. In JP-A-58-28737, an example of the photosensitive layer is described in which water-soluble polyvinyl acetal is used as a binder.

Indeed using these binders allows to form a photosensitive layer using water-soluble coating liquid, and is advantageous environmentally and economically.

If a polymer such as gelatin, polyvinyl alcohol, and water-soluble polyacetal is used as a binder, however, dehydration/shrinkage and thermal expansion of the binder occur simultaneously during heat development, wrinkles are generated in the film, and only films are obtained which are inappropriate for color print used by overlapping because the thermal expansion profile is different from that of the support.

On the other hand, an apparatus and a method for thermally developing a heat development recording material are generally well known (See e.g., U.S. Pat. No. 3,629,549 to Svendsen, U.S. Pat. No. 3,648,019 to Brewitz, U.S. Pat. No. 3,709,472 to Kreitz et al., and U.S. Pat. No. 4,518,845 to Svendsen).

Svendsen disclosed a developing apparatus having a thermally insulated drum attached concentrically in a heating material (See U.S. Pat. Nos. 3,629,549 and 4,518,845).

A film sheet to develop is connected with a drum to be driven with a fringe of a heating material. This type of heat development apparatus is, however, is not suited for a film having a comparatively soft thermoplastic polymer binder in its outermost layer. The surface of the side which supports emulsion contacts with an insulating drum or a heating material, so that the outermost layer of the film may receive scratch scars and/or adhesion marks.

Another type of heat development apparatus is equipped with a heating drum which electrostatically electrifies to hold the film during development. In this type of apparatus, the outermost layer of the film in the emulsion-supporting side does not contact either with the drum or other components, so that the above-mentioned scratch scars are not created. The electrostatic apparatus to hold a film on the drum during development is, however, comparatively complicated, and the shape is not suited to develop a large size of film.

Recently a thermal developing apparatus was disclosed in which small rollers are placed closely each other on a heating drum to hold a film between the drum and the small rollers to heat and transport (See WO97-13181).

This method is so well designed that a fold or scratch scar is not created on the film. When a heat development recording material is developed having a protection layer and/or a back layer in which latex of a polymer having a low glass transition temperature is used as a binder, however, such troubles may occur that irregular gloss is generated which is caused by adhesion of the surface of the drum or small rollers, or that irregular density is generated which is caused by thermal expansion of the film although this occurs seldom during development.

Therefore, technology has been required which provides a heat development photosensitive material 1) which is an environmentally and economically excellent aqueous photosensitive material, 2) which gives an coating surface having good quality, 3) which does not cause irregular density during development, 4) which is excellent in tolerance against scars, 5) which does not cause a "jamming" trouble in transport during heat development, and 6) which allows stable development for a long period, and a method for thermally developing the same.

The objective of the present invention is to provide a heat development photosensitive material 1) which has photographic properties such as high contrast and low overlapping for photolithography, particularly for scanner image setter, and 2) which has a stable heat development property for a long period, and a method for thermally developing the same.

SUMMARY OF THE INVENTION

The above objective was achieved by the following means:

1) A heat-developable image-recording material having a support, at least one image-forming layer on the support and at least one protecting layer on the image-forming layer, said heat-developable image-recording material being developed by use of a heat development apparatus comprising a roller coming into a driving contact with a surface of said material on the side having said image-forming layer, said apparatus comprising a smooth surface coming into a sliding contact for transport with a surface of said material opposite to said surface on the side having said image-forming layer, wherein at the temperature where said development is carried out, the ratio is 1.5 or more of the coefficient of friction between said surface on the side having said image-forming layer and a surface of said roller of said heat development apparatus, to the coefficient of friction between said surface opposite to said surface on the side having said image-forming layer and said smooth surface of said heat development apparatus.

2) A heat-developable image-recording material of 1), wherein said heat-developable image-recording material has at least one back layer on the opposite side to the side having said image-forming layer.

3) A heat-developable image-recording material of 2), wherein the outermost layer of said back layer contains a lubricant.

4) A heat-developable image-recording material of 1), wherein the outermost layer of said back layer contains a polymer binder having a glass transition temperature of 25° C. or higher.

5) A heat-developable image-recording material of 1), wherein said protecting layer at the outermost surface contains a polymer latex as a binder.

6) A heat-developable image-recording material of 1), wherein said image-forming layer contains a polymer latex as a binder.

7) A heat-developable image-recording material of 1), wherein the side having said image-forming layer contains a compound represented by any one of formulae 1 to 3 or a hydrazine derivative:

(1)

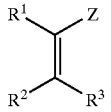

(2)

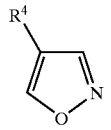

(3)

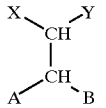

(In formula 1, $R^1$, $R^2$, and $R^3$ are each independently H or a substituted group, and Z is an electron attracting group or silyl group. $R^1$ and Z, $R^2$ and $R^3$, $R^1$ and $R^2$, or $R^3$ and Z can bind each other to form a ring structure. In formula 2, $R^4$ is a substituted group. In formula 3, X and Y are each independently H or a substituted group. A and B are each independently an alkoxy group, an alkylthio group, an alkylamino group, an aryloxy group, an arylthio group, or anilino group, X and Y, or A and B can bind each other to form ring structure.)

8) A heat-developable image-recording material of 7), wherein said hydrazine derivative is a compound having a chemical structure represented by formula H.

(H)

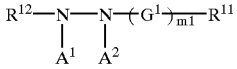

(In the chemical structure, $R^{12}$ is an aliphatic group, an aromatic group, or a heterocyclic group. $R^{11}$ is H or a blocking group. $G^1$ is CO, COCO, C(=S), $SO_2$, SO, $PO(R^{13})$ ($R^{13}$ is selected in a way similar to $R^{11}$; $R^{13}$ and $R^{11}$ can be different), or iminomethylene group. $A^1$ and $A^2$ are both H, or one of them is H and the other is a (substituted) alkylsulfonyl group, a (substituted) arylsulfonyl group, or a (substituted) acyl group, m1 is 0 or 1. When m1 is 0, $R^{11}$ is an aliphatic group, an aromatic group, or a heterocyclic group.

9) A method of developing a heat-developable image-recording material having a support, at least one image-forming layer on the support and at least one protecting layer on the image-forming layer, by use of a heat development apparatus comprising a roller coming into a driving contact with a surface of said material on the side having said image-forming layer, said apparatus comprising a smooth surface coming into a sliding contact for transport with a surface of said material opposite to said surface on the side having said image-forming layer, wherein at the temperature where said development is carried out, the ratio is 1.5 or more of the coefficient of friction between said surface on the side having said image-forming layer and a surface of said roller of said heat development apparatus, to the coefficient of friction between said surface opposite to said surface on the side having said image-forming layer and said smooth surface of said heat development apparatus.

10) A method of developing a heat-developable image-recording material of 9), wherein the surface of said roller of said heat development apparatus which makes contact with the surface on the side having said image-forming layer is made of silicone rubber.

11) A method of developing a heat-developable image-recording material of 9), wherein said smooth surface of said heat development apparatus which makes contact with said surface opposite to said surface on the side having said image-forming layer is formed of aromatic polyamide unwoven fabrics or Teflon (PTFE) unwoven fabrics.

BRIEF DESCRIPTION OF THE DRAWINGS

FIG. 1 is a side elevational view showing an example of the construction of a heat development apparatus which can be used when the present invention is carried out.

DETAILED DESCRIPTION OF THE INVENTION

The heat-developable image-recording material according to the present invention has an image-forming layer containing an organic silver salt, a reducing agent, and a photosensitive silver halide on a support, and at least one protecting layer(s) is/are placed on the image-forming layer. It is preferable that the heat-developable image-recording material according to the present invention has at least one back layer(s) on the opposite side (back surface) to the image-forming layer against a support. A polymer latex is used as a binder of a back layer when an image-forming layer, a protecting layer, and a back layer are used. Using a polymer latex on these layers enables coating of an aqueous mixture containing water as a solvent (dispersion medium), makes it's user advantageous environmentally and economically, and gives a heat-developable image-recording material which does not generate folds during heat development. In addition, using a specified heat-treated support gives a heat-developable image-recording material whose size does not change much after heat development.

Such a heat-developable image-recording material is developed using a heat development apparatus (heat developer), wherein the surface of the side of the image-forming layer of the heat-developable image-recording material is contacted with rollers, the rollers are driven, and the surface of the back surface is contacted with the smooth surface to slide and transport the heat-developable image-recording material, wherein a ratio of the coefficient of friction between the surface of the side having the above-mentioned image-forming layer and the surface of the rollers of the above-mentioned developing apparatus to the coefficient of friction between the surface of the opposite side to the side having the above-mentioned image-forming layer and the smooth surface of the above-mentioned developing apparatus is regulated at 1.5 or more at the temperature of the above-mentioned development, so that irregular treatment or transportation trouble does not occur.

Polymer latex used for the binder of the present invention comprises water-insoluble hydrophobic polymer fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex for use in the present invention is described in Gosei Jushi Emulsion (Synthetic, Resin Emulsion), compiled by Taira Okuda and Hiroshi Inagaki, issued by Kobunshi Kanko Kai (1978), Gosei Latex no Oyo (Coating of Synthetic Latex), compiled by Takaaki Sugimura, Yasuo Kataoka, Souichi Suzuki and Keishi Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a monodisperse particle size distribution.

As the polymer latex used for the present invention, a so-called core/shell type latex may be used other than the normal polymer latex having a uniform structure. In this case, it is preferred in some cases that the core and the shell have different glass transition temperatures.

The polymer latex used as the binder in the present invention has a glass transition temperature (Tg) of which preferred range may be different among those for the protective layer, the back layer and the image-forming layer. In the protective layer and the back layer, the glass transition temperature is preferably 25° C. or over, in particular 25° C. to 100° C. in view of film strength and prevention of adhesion failure, because the protective layer and the back layer are brought into contact with various instruments. In the image-forming layer, the glass transition temperature is preferably from −30° C. to 40° C., particularly preferably from 0° C. to 40° C. so as to accelerate the diffusion of the photographically useful materials during the heat development, and to obtain good photographic properties such as high Dmax and low fogging. The gel fraction of the polymer latex used for the image-forming layer is desirably 30–90% by weight for similar reasons. The gel fraction in this case is one obtained according to the following equation by forming a film sample from a polymer latex at a drying temperature of 70° C., immersing the film sample in tetrahydrofuran (THF) at 25° C. for 24 hours, and measuring the amount of insoluble matter.

$$\text{Gel fraction (wt \%)} = [\text{Weight of insoluble matter (g)}/\text{Weight of film using polymer latex (g)}] \times 100.$$

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), ibid.

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film-forming property is disadvantageously poor.

Specific examples of the polymer latex used as a binder in the image-forming layer of the heat-developable image-recording material of the present invention include a methyl methacrylate/ethyl acrylate/methacrylic acid copolymer latex, methyl methacrylate/2-ethylhexyl acrylate/hydroxyethyl methacrylate/styrene/acrylic acid copolymer latex, styrene/butadiene/acrylic acid copolymer latex, styrene/butadiene/divinylbenzene/methacrylic acid copolymer latex, methylmethacrylate/vinylchloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857x2 (all produced by Nippon Zeon Co., Ltd.), VONCORT R3340, R3360, R3370, 4280, 2830, 2210 (all produced by Dai-Nippon Ink & Chemicals, Inc.), Julimer ET-410, 530, SEK101-SEK301, FC30, FC35 (all produced by Nihon Junyaku Co., Ltd.), Polysol F410, AM200, AP50 (all produced by Showa Kobunshi Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40, VONDIC 1320NS (all produced by Dai-Nippon Ink & Chemicals, Inc.); rubber-based resins such as LACSTAR 7310K, 3307B, 4700H, 7132C, LQ-618-1 (all produced by Dai-Nippon Ink & Chemicals, Inc.), Nipol Lx416, 410, 430, 435, 2507 (all produced by Nippon Zeon Co., Ltd.); vinyl chloride resins such as Nipol G351, G576 (both produced by Nippon Zeon Co., Ltd.); vinylidene chloride resins such as L502, L513 (both produced by Asahi Chemical Industry Co., Ltd.), ARON D7020, D5040, D5071 (all produced by Toagosei Co., Ltd.); and olefin resins such as CHEMIPEARL S120 and SA100 (both produced by Mitsui Petrochemical Industries, Ltd.) and the like. These polymers may be used individually or if desired, as a blend of two or more thereof.

Among these polymer latexes, preferably used as the binder for the protective layer are those based on acrylic compound, styrene, acrylic compound/styrene, vinyl chloride, and vinylidene chloride. Specifically, those of acrylic resin type such as VONCORT R3370, 4280, Nipol Lx857, and methyl methacrylate/2-ethylhexyl acrylate/hydroxyethyl methacrylate/styrene/acrylic acid copolymers; those of vinyl chloride resin type such as Nipol G576; and those of vinylidene chloride resin type such as Aron D5071 are preferably used.

As the binder for the image-forming layer, polymer latexes based on styrene/butadiene are preferably used. Specifically, those of rubber resin type such as LACSTAR 3307B, Nipol Lx430 and 435 are preferably used.

As the binder for the back layer, polymer latexes based on acrylic compound, olefin, and vinylidene chloride are preferably used. Specifically, those of acrylic resin type such as Julimer ET-410, CEBIAN A-4635 and Polysol F410, olefin resin type such as CHEMIPEARL S120, vinylidene chloride type such as L502 and ARON D7020 and the like are preferred.

The binder used for the present invention may contain a hydrophilic polymer, if desired, in an amount of 20% by weight or less of the entire binder, such as polyvinyl alcohol, methyl cellulose, hydroxypropyl cellulose, carboxymethyl cellulose and hydroxypropylmethyl cellulose. The amount of the hydrophilic polymer added is preferably 10% by weight or less of the entire binder in the protective layer or the image-forming layer.

The photographic layer of the present invention is preferably formed by coating an aqueous coating solution and then drying it. The term "aqueous" as used herein means that 60% by weight or more of the solvent (dispersion medium) in the coating solution is composed of water. The component other than water of the coating solution may be a water-miscible organic solvent such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The total binder amount in the protective layer according to the present invention is preferably from 0.2 to 5.0 g/m$^2$, more preferably from 0.5 to 3.0 g/m$^2$.

The total binder amount in the image-forming layer according to the present invention is preferably from 0.2 to 30 g/m$^2$, more preferably from 1.0 to 15 g/m$^2$.

The total binder amount in the back layer according to the present invention is preferably from 0.01 to 3 g/m$^2$, more preferably from 0.05 to 1.5 g/m$^2$.

Each layer may contain a crosslinking agent for crosslinking, surfactant for improving coatability and the like.

Two or more layers may be provided for each of these layers. When the image-forming layer is composed of two or more layers, it is preferred that all of the layers contain a polymer latex as a binder. The protective layer is provided on the image-forming layer, and it may also be composed of two or more layers. In such a case, it is preferred that at least one layer thereof, in particular, the outermost layer of the protective layer contains a polymer latex as a binder. The back layer is provided on an undercoat layer provided on the back face of the support, and it may also be composed of two or more layers. In such a case, it is preferred that at least one layer thereof, in particular, the outermost layer of the back layer contains a polymer latex as a binder.

According to the present invention, the ratio of the coefficient of the friction between the surface of the outermost layer of the side having an image-forming layer of the heat-developable image-recording material and the surface of a heat developer ($\mu_e$) to the coefficient of the friction between the surface of the outermost layer of the back surface and the smooth surface of a heat developer ($\mu_b$) is determined by determining coefficients of dynamic friction of the surface of the image-recording material in contact with rollers and smooth surface materials of the heat developer at a heat development temperature at a given rate at a given loading, and determining a ratio of these according to the following equation:

Ratio of coefficients of friction=Coefficient of the friction between a roller material and the surface having an image-forming layer of a heat developer ($\mu_e$)/Coefficient of the friction between a smooth surface material and a back surface of a heat developer ($\mu_b$).

The value is 1.5 or more, usually 30 or so. There is no upper limit.

Although the heat development temperature is usually constant (except the heating temperature for preheating), the above-mentioned heat development temperature is 80–150°

C., preferably 100–130° C., in the case the temperature is varied. The ratio of coefficients of friction in such a case is determined from $\mu_e$ and $\mu_b$ at the maximal temperature.

In the present invention, slidability of the outermost layer of the surface having an image-forming layer and/or an opposite surface to it with a heat developer material at a heat development temperature can be adjusted by including a lubricant in the outermost layer and changing the amount to add.

Any compound which diminishes a coefficient of friction of the surface of a material, compared with the case without the compound, can be used as a lubricant in the present invention.

Typical lubricants used in the present invention include, for example, silicone-based lubricants (See U.S. Pat. No. 3,042,522, BD Patent No. 955,061, U.S. Pat. Nos. 3,080, 317, 4,004,927, 4,047,958 and 3,489,567, and GB Patent No. 1,143,118), higher fatty acid-based, alcohol-based, and acid amide-based lubricants (See U.S. Pat. Nos. 2,454,043, 2,732,305, 2,976,148 and 3,206,311, DE Patent Nos. 1,284, 295 and 1,284,294), a metal soap (See GB Patent No. 1,263,722 and U.S. Pat. No. 3,933,516), ester-based and ether-based lubricants (See U.S. Pat. Nos. 2,588,765 and 3,121,060, and GB Patent No. 1,198,387), and taurine-based lubricants (See U.S. Pat. Nos. 3,502,473 and 3,042,222).

Preferably used lubricants include Cellosol 524 (mainly containing carnauba wax), Polylon A, 393, and H-481 (mainly containing polyethylene wax), Himicron G-110 (mainly containing ethylene bis(stearic acid) amide), Himicron G-270 (mainly containing stearic acid amide). All of these are products by Chukyo Oil & Fat Co., Ltd.

The amount of the lubricants is 0.1 to 50 wt. % of the amount of the binder contained in the addition layer.

For the heat-developable image-recording material of the present invention, various kinds of support can be used. Typical supports comprises polyester such as polyethylene terephthalate, and polyethylene naphthalate, cellulose nitrate, cellulose ester, polyvinylacetal, polycarbonate or the like. Among these, biaxially stretched polyester, especially polyethylene terephthalate (PET), is preferred in view of strength, dimensional stability, chemical resistance and the like. The support preferably has a thickness of 90–180 $\mu$m as a base thickness except for the undercoat layer.

Preferably used as the support of the heat-developable image-recording material of the present invention is a polyester film, in particular polyethylene terephthalate film, subjected to a heat treatment in a temperature range of 130–210° C. in order to relax the internal distortion formed in the film during the biaxial stretching so that dimensional change distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image-forming layer and the back layer to the support, for example, coating of the undercoat layer and the like.

The dimensional change of the support upon heating at 120° C. for 30 seconds is preferably −0.03% to +0.01% for the machine direction (MD), and 0 to 0.04% for the transverse direction (TD).

The support may be applied with an undercoat layer containing SBR, vinylidene chloride, polyester, gelatin or the like as a binder, as required. The undercoat layer may be composed of multiple layers, and may be provided on one side or both sides of the support. At least one of the undercoat layers may be an electroconductive layer. The undercoat layer generally has a thickness of 0.01–5 $\mu$m, more preferably 0.05–1 $\mu$m (for one layer). When it is an electroconductive layer, it preferably has a thickness of 0.01–1 $\mu$m, more preferably 0.03–0.8 $\mu$m.

The back layer next to the support of the heat-developable image-recording material of the present invention and the undercoat layer preferably contain metal oxides in order to reduce dust adhesion, and it is preferred that at least one of the back layer and the undercoat layer (those provided on the both side of the support) should be an electroconductive layer. However, the electroconductive layer is preferably not the outermost layer of the back layer.

As the metal oxide used for this, those disclosed in JP-A-61-20033 (the code "JP-A" as used herein means an "unexamined published Japanese patent application") and JP-A-56-82504 are particularly preferred.

According to the present invention, the amount of the electroconductive metal oxide is preferably 0.05–20 g, particularly preferably 0.1–10 g per 1 m$^2$ of the image-recording material. Surface resistivity of the metal oxide-containing layer is not more than $10^{12}\Omega$, preferably not more than $10^{11}\Omega$ under an atmosphere of 25° C. and 25% RH. Such surface resistivity affords good antistatic property. The lower limit of the surface resistivity is not particularly limited, but it is generally around $10^7\Omega$.

According to the present invention, further improved antistatic property can be obtained by using a fluorine-containing surfactant in addition to the aforementioned metal oxide.

The preferred fluorine-containing surfactants for use in the invention are surfactants which have a fluoroalkyl, fluoroalkenyl or fluoroaryl group which has at least 4 carbon atoms (usually 15 or less), and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544and British Patent No. 1,439,402. Specific examples of these materials are indicated below.

F-1

$$C_8F_{17}SO_3K$$

F-2

$$C_8F_{17}SO_2\underset{}{\overset{C_3H_7}{\overset{|}{N}}}-CH_2COOK$$

-continued

F-3

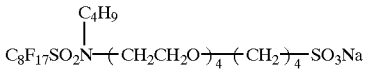

F-4

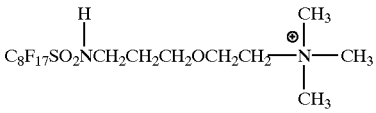

F-5

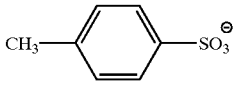

$C_8F_{17}SO_3Li$

No limitation is imposed upon the layer to which the fluorine-containing surfactant is added provided that it is included in at least one layer of the image-recording material, and it can be included, for example, in the surface protecting layer, emulsion layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it maybe used in the form of an overcoat over the surface protective layer.

The amount of fluorine-containing surfactant used in this invention may be from 0.0001 to 1 g, preferably from 0.0002 to 0.25 g, particularly desirably from 0.0003 to 0.1 g, per 1 $m^2$ of the image-recording material.

Furthermore, two or more of the fluorine-containing surfactants can be mixed together.

Beck smoothness in the present invention can be easily determined by Japanese Industrial Standard (JIS) P8119, "Test Method for Smoothness of Paper and Paperboard by Beck Test Device" and TAPPI Standard Method T479.

Beck smoothness of at least one, or preferably both of the outermost layers of the image-forming layer side and the opposite side of the heat-developable image-recording material according to the present invention is 2000 seconds or less, preferably from 10 seconds to 2000 seconds.

Beck smoothness of the outermost layers of the image-forming layer side and the opposite side of the heat-developable image-recording material according to the present invention can be controlled by changing an average particle diameter and an addition amount of microparticles called matting agent incorporated into the outermost layers on the both sides. The matting agent is preferably contained in the outermost layer of the protective layer remotest from the support for the side of the image-forming layer, and in a layer of the back layer which is not the outermost layer for the opposite side.

The average particle diameter of the matting agent in the present invention is preferably in the range of from 1 to 10 $\mu$m.

The amount of the matting agent added in the present invention is preferably in the range of from 5 to 400 mg/$m^2$, particularly in the range of from 10 to 200 mg/$m^2$.

The matting agent used in the present invention may be any solid particles so long as they do not adversely affect various photographic properties. Inorganic matting agents include silicon dioxide, titanium and aluminum oxides, zinc and calcium carbonates, barium and calcium sulfates, calcium and aluminum silicates and the like, and organic matting agents include cellulose esters, organic polymer matting agents such as those of polymethyl methacrylate, polystyrene or polydivinylbenzene, copolymers thereof and the like.

In the present invention, it is preferred to use a porous matting agent described in JP-A-3-109542, page 2, lower left column, line 8 to page 3, upper right column, line 4, a matting agent in which the surface thereof has been modified with an alkali described in JP-A-4-127142, page 3, upper right column, line 7 to page 5, lower right column, line 4, or a matting agent of an organic polymer described in JP-A-6-118542, Paragraph Nos. [0005] to [0026].

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 $\mu$m or more and a matting agent having an average particle diameter of 1 $\mu$m or less as described in JP-A-6-118542) can be used.

According to the present invention, the outermost layers on the image-forming layer side and/or the opposite side preferably contain a lubricant.

The photosensitive silver halide for use in the present invention may be any of silver chloride, silver chlorobromide, and silver iodochlorobromide. The halogen composition distribution within the grain may be uniform, or the halogen composition may be changed stepwise or continuously.

The method of forming photosensitive silver halide used for the present invention is well known in the art and, for example, the methods described in *Research Disclosure,* No. 17029 (June, 1978) and U.S. Pat. No. 3,700,458 may be used. Specifically, a method comprising converting a part of silver in the produced organic silver salt to photosensitive silver halide by adding a halogen-containing compound to the organic silver salt, or a method comprising adding a silver-supplying compound and a halogen-supplying compound to gelatin or other polymer solution to thereby prepare photosensitive silver halide and mixing the silver halide with an organic silver salt may be used for the present invention. The photosensitive silver halide grain preferably has a small grain size so as to prevent high white turbidity after the formation of an image. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an ridge of the silver halide grain in the case where the silver halide grain is a regular crystal such as cubic or octahedral grain; the diameter of a circle image having the same area as the projected area of the main surface plane in the case where the silver halide grain is a tabular silver halide grain; or the diameter of a sphere having the same volume as the silver halide grain in the case of other irregular crystals such as spherical or bar grain.

Examples of the shape of the silver halide grain include cubic form, octahedral form, tabular form, spherical form, stick form and bebble form, and among these, cubic grain and tabular grain are preferred in the present invention. When a tabular silver halide grain is used, the average aspect ratio is preferably from 100:1 to 2:1, more preferably from 50:1 to 3:1. A silver halide grain having rounded corners is also preferably used. The face index (Miller indices) of the outer surface plane of a photosensitive silver halide grain is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, *J. Imaging Sci.,* 29, 165 (1985) using the adsorption dependency of [111] face and [100] face upon adsorption of the sensitizing dye.

The photosensitive silver halide grain for use in the present invention contains a metal or metal complex of Group VII or VIII in the Periodic Table. The center metal of the metal or metal complex of Group VII or VIII of the Periodic Table is preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide grains previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion grains or at respective stages before coating of the emulsion. However, the rhodium compound is preferably added at the time of formation of the emulsion and integrated into the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RUCl_4(H_2O)_2]^{-}$ | $[RUCl_5(H_2O)]^{2-}$ |
| $[RUCl_5(NO)]^{2-}$ | $[RuBr_5(NS)]^{2-}$ | |
| $[RU(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compound is preferably from $1\times10^{-9}$ to $1\times10^{-5}$ mol, more preferably from $1\times10^{-8}$ to $1\times10^{-6}$ mol, per mol of silver halide.

These compounds may be added appropriately at the time of preparation of silver halide emulsion grains or at respective stages before coating of the emulsion, but the compounds are preferably added at the time of formation of the emulsion and integrated into a silver halide grain.

For adding the compound during the grain formation of silver halide and integrating it into a silver halide grain, a method where a metal complex powder or an aqueous solution having dissolved therein the metal complex together with NaCl or KCl is added to a water-soluble salt or water-soluble halide solution during the grain formation, a method where the compound is added as the third solution at the time of simultaneously mixing a silver salt and a halide solution to prepare silver halide grains by the triple jet method, or a method where a necessary amount of an aqueous metal complex solution is poured into a reaction vessel during the grain formation, may be used. Among these, preferred is a method comprising adding a metal complex powder or an aqueous solution having dissolved therein the metal complex together with NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) maybe used. In place of using a water-soluble iridium, separate silver halide grains previously doped with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of grains.

The photosensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis(carbamoyl) tellurides, diacyl tellurides, bis(oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, JP-A-3-53693, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai (compiler), *The Chemistry of Organic Selenium and Tellurium Compounds,* Vol. 1 (1986), and ibid., Vol. 2 (1987). The compounds represented by formulae (II), (III) and (IV) of JP-A-5-313284 are particularly preferred.

The amount of the selenium and tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

Noble metal sensitizers for use in the present invention include gold, platinum, palladiumand iridium, and particularly, gold sensitization is preferred. Examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917A.

In the heat-developable image-forming material of the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the photosensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing photosensitive silver halide and organic silver salt which are prepared separately are not particularly limited as far as the effect of the present invention can be brought out satisfactorily. However, a method of mixing the silver halide grains and the organic silver salt after completion of respective preparations in a high-speed stirring machine, a ball mill, a sand mill, a colloid mill, a vibrating mill or a homogenizer or the like, or a method involving preparing organic silver salt while mixing therewith photosensitive silver halide after completion of the preparation in any timing during preparation of the organic silver salt, or the like may be used.

As a method for producing silver halides used for the present invention, the so-called halidation can also be preferably used, in which a part of silver of organic silver salts is halogenated with organic or inorganic halide. While the organic halide compound used for this method is not particularly limited so long as it can react with organic silver salt to form a silver halide, examples thereof include, for example, N-halogenoimides (N-bromosuccinimide etc.), halogenated quaternary nitrogen compounds (tetrabutylammonium bromide etc.), halogenated quaternary nitrogen compounds associated with halogen (pyridinium bromide perbromide etc.) and the like. As for the inorganic halide compound, while it is not particularly limited so long as it can react with organic silver salt to form a silver halide, examples thereof include, for example, alkali metal halides or ammonium halides (e.g., sodium chloride, lithium bromide, potassium iodide, ammonium bromide), alkali earth metal halides (e.g., calcium bromide, magnesiumchloride), transitionmetal halides (ferric chloride, cupric bromide etc.), metal complexes having halogen ligands (sodium bromoiridate, ammonium chlororhodate etc.), halogen atoms (bromine, chlorine, iodine etc.) and the like. The organic and inorganic halides can be used in a desired combination.

The amount of the halide compounds when the halidation is used for the present invention is preferably 1 mM to 500 mM, more preferably 10 mM to 250 mM in terms of halogen atom per 1 mol of the organic silver salt.

The organic silver salt which can be used in the present invention is a silver salt which is relatively stable against light but forms a silver image when it is heated at 80° C. or higher in the presence of an exposed photocatalyst (e.g., a latent image of photosensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70% by weight of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palpitate, silver maleate, silver fumarate, silver tartrate, silver linoleate, silver butyrate, silver camphorate and a mixture thereof.

Silver salts of compounds having amercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short axis and a long axis is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method involving obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelation function of the fluctuation of the scattered light to the change in time.

The organic silver salt which can be used in the present invention is preferably desalted. The desalting method is not particularly limited and a known method may be used. Known filtration methods such as centrifugal filtration, suction filtration, ultrafiltration and flocculation washing by coagulation may be preferably used.

The organic silver salt that can be used for the present invention is converted into a dispersion of solid microparticles using a dispersant in order to obtain coagulation-free microparticles of a small size. The organic silver salt can be mechanically made into a dispersion of solid microparticles by using a known means for producing microparticles (for example, ball mill, vibrating ball mill, planet ball mill, sand mill, colloid mill, jet mill, roller mill, high pressure homogenizer) in the presence of a dispersing aid.

When the organic silver salt is made into microparticles by using a dispersant, the dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers, semisynthetic anionic polymers such as carboxymethylated starch and carboxymethylcellulose, anionic polymers such as alginic acid and pectic acid, anionic surfactants such as those disclosed in JP-A-52-92716, WO88/04794 and the like, compounds disclosed in JP-A-9-179243, known anionic, nonionic and cationic surfactants, other known polymers such as polyvinyl alcohol, polyvinylpyrrolidone, carboxymethylcellulose, hydroxypropylcellulose, and hydroxypropylmethylcellulose, naturally occurring polymers such as gelatin and the like.

The dispersing aid is generally mixed with the organic silver salt in a form of powder or wet cake before the dispersing operation, and fed as slurry into a dispersing apparatus. However, it may be mixed with the organic silver salt beforehand, and subjected to a treatment by heating, with solvent or the like to form organic silver salt powder or wet cake. The pH may be controlled with a suitable pH modifier during or after the dispersing operation.

Other than the dispersing operation by a mechanical means, the organic silver salt can be made into microparticles by roughly dispersing it in a solvent through pH control, and then changing the pH in the presence of a dispersant. For this operation, an organic solvent may be used as the solvent for roughly dispersing the organic silver salt, and such an organic solvent is usually removed after the formation of microparticles.

The produced dispersion can be stored with stirring in order to prevent precipitation of the microparticles during storage, or stored in a highly viscous state formed with a hydrophilic colloids (e.g., a jelly state formed with gelatin). Further, it may be added with a preservative in order to prevent saprophytic proliferation during the storage.

While the organic silver salt can be used for the present invention at any desired amount, it is preferably used in an amount of 0.1–5 g/m$^2$, more preferably 1–3 g/m$^2$ per square meter of the heat-developable image-recording material.

The heat-developable image-recording material of the present invention contains a reducing agent for organic silver salt. The reducing agent for organic silver salt may be any substance, preferably an organic substance, which reduces the silverion to metal silver. Conventional photographic developers such as phenidone, hydroquinone and catechol are useful, but a hinderedphenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat-developable photosensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, DE Patent No. 2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2-dihydroxy-1,1-binaphthyl, 6,6-dibromo-2,2-dihydroxy-1,1-binaphthyl and bis(2-hydroxy-1-naphthyl)methane; combinations of a bis-β-naphthol with a 1,3-dihydroxybenzene derivative (e.g., 2,4-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2, 6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a blackened silver image depending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat-developable photosensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, GB Patent No. 1,380,795and Belgian Patent No. 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be added in any form of a solution, powder, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

The heat-developable image-recording material of the present invention preferably contains an ultrahigh contrast agent, preferably in the image-forming layer and/or another layer adjacent thereto so as to obtain a high-contrast image. Preferred examples of the ultrahigh contrast agent for use in the present invention include substituted alkene derivatives represented by the formula (1), substituted isooxazole derivatives represented by the formula (2), specific acetal compounds represented by the formula (3) and hydrazine derivatives.

The substituted alkene derivatives represented by the formula (1), substituted isooxazole derivatives represented by the formula (2), specific acetal compounds represented by the formula (3) for use in the present invention will be explained below.

(1)

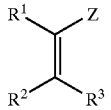

(2)

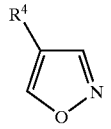

(3)

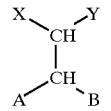

In the general formula (1), $R^1$, $R^2$ and $R^3$ each independently represents a hydrogen atom or a substituent, Z represents an electron withdrawing group or a silyl group, and $R^1$ and Z, $R^2$ and $R^3$, $R^1$ and $R^2$, or $R^3$ and Z may be combined with each other to form a ring structure; in the formula (2), $R_4$ represents a substituent; and in the formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y, or A and B may be combined with each other to form a ring structure.

The compound represented by the formula (1) is described in detail below.

In the formula (1) , $R^1$, $R^2$ and $R^3$ each independently represents a hydrogen atom or a substituent, and Z represents an electron withdrawing group or a silyl group. In the formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, ahydroxy group (or a salt thereof), an alkoxy group (including a group containing an ethyleneoxy group or propyleneoxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl orheterocyclic)amino group an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in the formula (1) is a substituent having a Hammett's substituent constant σp of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group (or a salt thereof), a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group.

The electron withdrawing group represented by Z in the formula (1) may further have a substituent and examples of the substituent include those described for the substituent which the substituent represented by $R^1$, $R^2$ or $R^3$ in the formula (1) may have.

In the formula (1), $R^1$ and Z, $R^2$ and $R^3$, $R^1$ and $R^2$, or $R^3$ and Z may be combined with each other to form a ring structure. The ring structure formed is a non-aromatic carbocyclic ring or a non-aromatic heterocyclic ring.

The preferred range of the compound represented by the formula (1) is described below.

The silyl group represented by Z in the formula (1) is preferably a trimethylsilyl group, a t-butyldimethylsilyl group, a phenyldimethylsilyl group, a triethylsilyl group, a triisopropylsilyl group or a trimethylsilyldimethylsilyl group.

The electron withdrawing group represented by Z in the formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted by any electron withdrawing group, still more preferably a cyano group, a formyl group, an acyl group, an alkoxycarbonyl group, an imino group or a carbamoyl group.

The group represented by Z in the formula (1) is preferably an electron withdrawing group.

The substituent represented by $R^1$, $R^2$ or $R^3$ in the formula (1) is preferably a group having a total carbon atom number of from 0 to 30 and specific examples of the group include a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

In the formula (1), $R^1$ is preferably an electron withdrawing group, an aryl group, an alkylthio group, an alkoxy group, an acylamino group, a hydrogen atom or a silyl group.

When $R^1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted by N atom, an alkylsulfonyl group, an arylsulfonyl group, a carbamoyl group, a sulfamoyl group, a trifluoromethyl group, a phosphoryl group, a carboxy group (or a salt thereof), a saturated or unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group (or a salt thereof) or a saturated or unsaturated heterocyclic group, still more preferably a cyano group, a formyl group, an acyl group, an alkoxycarbonyl group, a carbamoyl group or a saturated or unsaturated heterocyclic group.

When $R^1$ represents an aryl group, the aryl group is preferably a substituted or unsubstituted phenyl group having a total carbon atom number of from 6 to 30. The substituent maybe any substituent but an electron withdrawing substituent is preferred.

In the formula (1), $R^1$ is more preferably an electron withdrawing group or an aryl group.

The substituent represented by $R^2$ or $R^3$ in the formula (1) is preferably a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

In the formula (1), it is more preferred that one of $R^2$ and $R^3$ is a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, still more preferably a hydroxy group (or a salt thereof), an alkoxy group or a heterocyclic group.

In the formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 30.

The compound represented by the formula (1) is more preferably a compound where Z represents a cyano group, a formyl group, an acyl group, an alkoxycarbonyl group, an imino group or a carbamoyl group, $R^1$ represents an electron withdrawing group or an aryl group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, more preferably a compound where Z and $R^1$ form a non-aromatic 5-, 6- or 7-membered ring structure and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group. At this time, Z which forms a non-aromatic ring structure together with $R^1$ is preferably an acyl group, a carbamoyl group, an oxycarbonyl group, a thiocarbonyl group or a sulfonyl group and $R^1$ is preferably an acyl group, a carbamoyl group, an oxycarbonyl group, a thiocarbonyl group, a sulfonyl group, an imino group, an imino group substituted by N atom, an acylamino group or a carbonylthio group.

The compound represented by the formula (2) is described below.

In the formula (2), $R^4$ represents a substituent. Examples of the substituent represented by $R^4$ include those described for the substituent represented by $R^1$, $R^2$ or $R^3$ in the formula (1).

The substituent represented by $R^4$ is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R^4$ represents anaryl group, the aryl group is preferably a substituted or unsubstituted phenyl group having a total carbon atom number of from 0 to 30. Examples of the substituent include those described for the substituent represented by $R^1$, $R^2$ or $R^3$ in the formula (1).

$R^4$ is more preferably acyano group, analkoxycarbonyl group, a carbamoyl group, a heterocyclic group or a substituted or unsubstituted phenyl group, most preferably a cyano group, a heterocyclic group or an alkoxycarbonyl group.

The compound represented by the formula (3) is described in detail below.

In the general formula (3), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B maybe combined with each other to form a ring structure.

Examples of the substituent represented by X or Y in the general formula (3) include those described for the substituent represented by $R^1$, $R^2$ or $R^3$ in the formula (1). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group (or a salt thereof), a sulfo group (or a salt thereof), a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group and a silyl group.

These groups each may further have a substituent. X and Y may be combined with each other to form a ring structure and the ring structure formed maybe either anon-aromatic carbocyclic ring or a non-aromatic heterocyclic ring.

In the general formula (3), the substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In the general formula (3), X and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y for forming a ring structure each is preferably an acyl group, a carbamoyl group, an oxycarbonyl group, a thiocarbonyl group, a sulfonyl group, an imino group, an imino group substituted by N atom, an acylamino group or a carbonylthio group.

In the general formula (3), A and B each independently represents an alkoxy group, an alkylthio group, an alkylamino group, an aryloxy group, an arylthio group, an anilino group, a heterocyclic thio group, a heterocyclic oxy group or a heterocyclic amino group, which may be combined with each other to form a ring structure. Those represented by A and B in the formula (3) are preferably a group having a total carbon atom number of from 1 to 40, more preferably from 1 to 30, and the group may further have a substituent.

In the general formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. Examples of the linked structure (—A—B—) formed by A and B include —O—$(CH_2)_2$—O—, —O—$(CH_2)_3$—O—, —S—$(CH_2)_2$—S—, —S—$(CH_2)_3$—S—, —S—ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—ph—O—, —N$(CH_3)$—ph—S— and —N(ph)—$(CH_2)_2$—S—.

Into the compound represented by the general formula (1), (2) or (3) for use in the present invention, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

Into the compound represented by the formula (1), (2) or (3) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by the formula (1), (2) or (3) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl orheterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the formulae (1) to (3) for use in the present invention are shown below. However, the present invention is by no means limited to the following compounds.

C-1

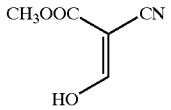

-continued

C-2

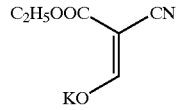

C-3

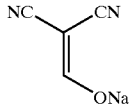

C-4

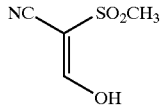

C-5

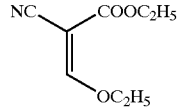

C-6

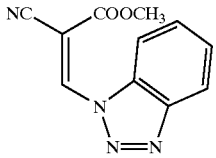

C-7

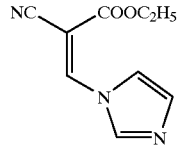

C-8

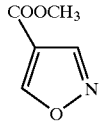

C-9

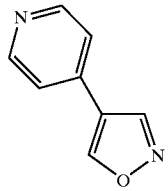

C-10

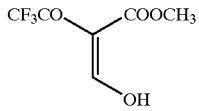

C-11

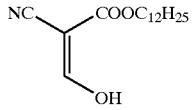

C-12

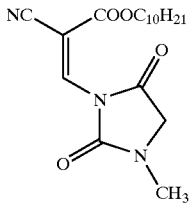

-continued
C-13
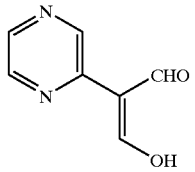
C-14
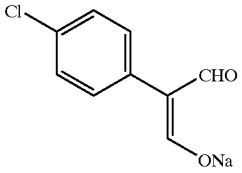
C-15
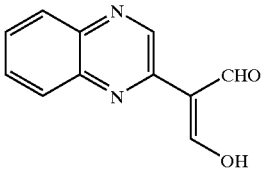
C-16
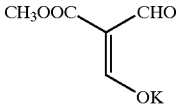
C-17
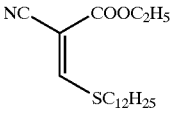
C-18
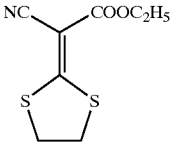
C-19
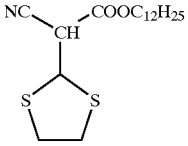
C-20
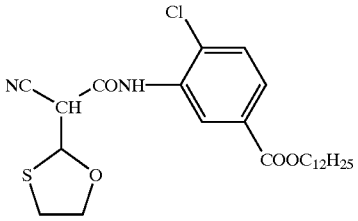
C-21
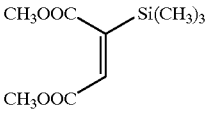
C-22
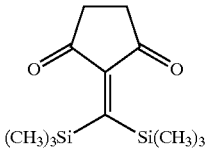
-continued
C-23
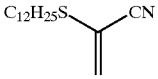
C-24
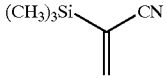
C-25
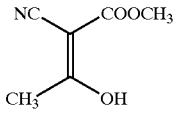
C-26
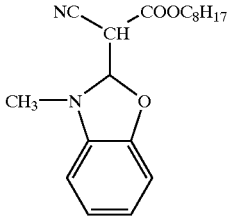
C-27
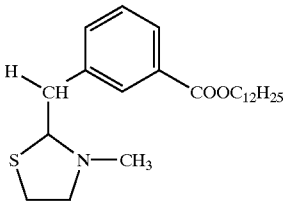
C-28
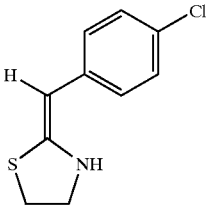
C-29
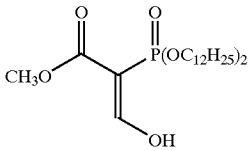
C-30
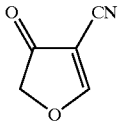
C-31
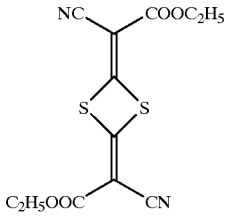

-continued
C-32
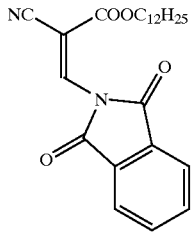
C-33
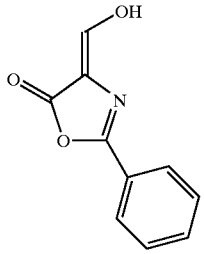
C-34
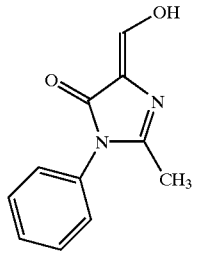
C-35
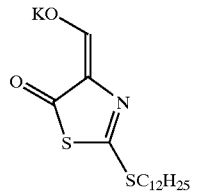
C-36
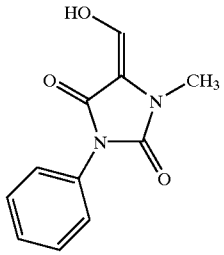
C-37
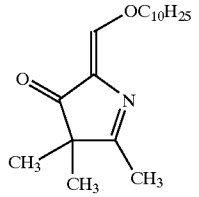
-continued
C-38
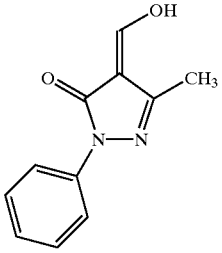
C-39
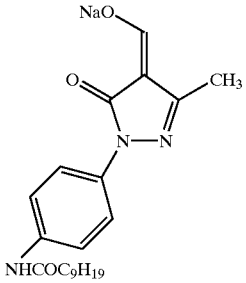
C-40
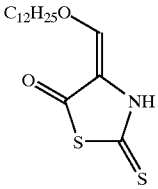
C-41
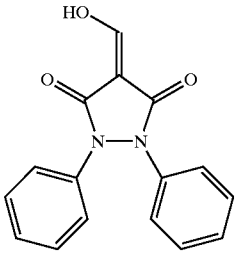
C-42
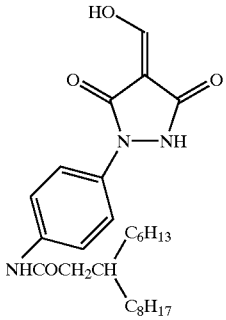

-continued
C-43
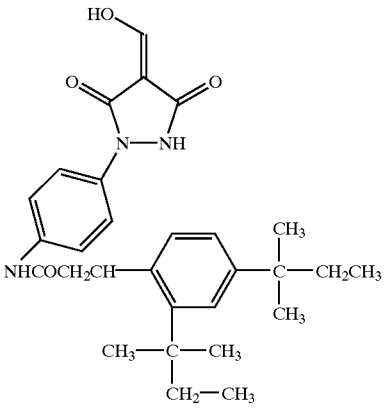
C-44
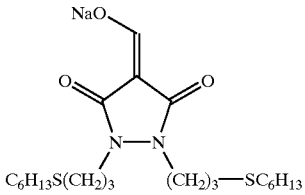
C-45
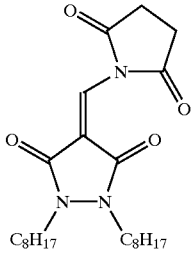
C-46
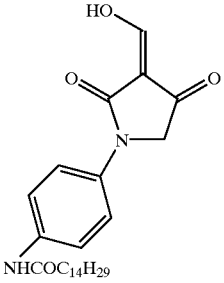
C-47
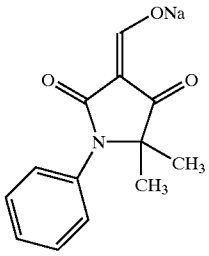
-continued
C-48
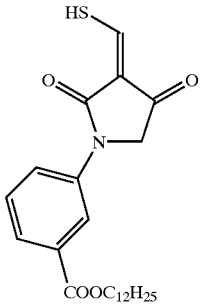
C-49
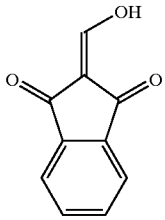
C-50
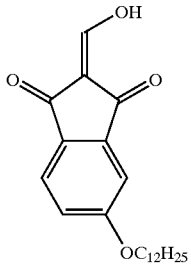
C-51
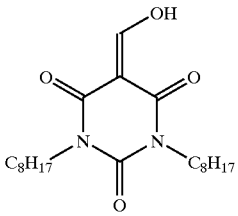
C-52
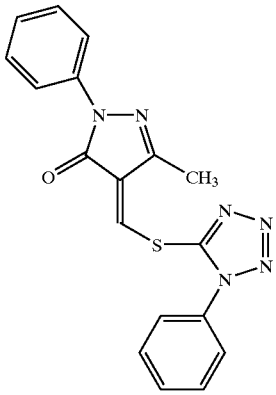

-continued

C-53

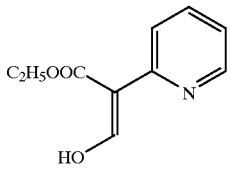

C-54

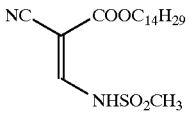

C-55

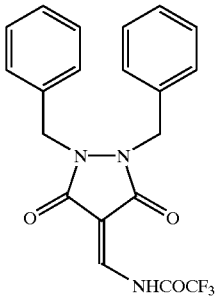

C-56

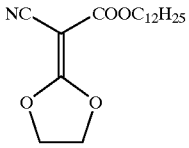

C-57

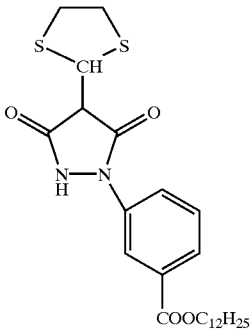

C-58

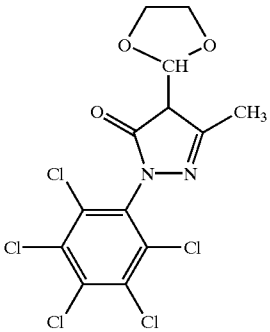

-continued

C-59

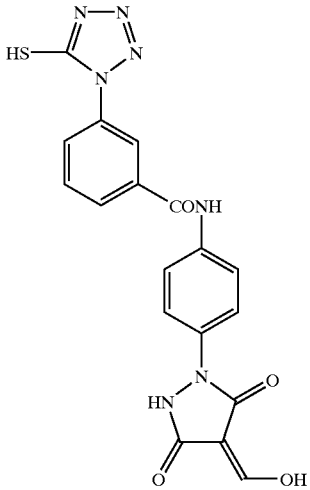

C-60

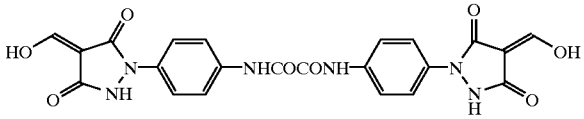

The compounds represented by the formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds represented by the formulae (1) to (3) for use in the present invention each maybe dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by the formulae (1) to (3) each may be used after dispersing the powder of the compound in an appropriate solvent such as water by a method known as a solid dispersion method, using a ball mill, a colloid mill or an ultrasonic wave.

The compounds represented by the formulae (1) to (3) for use in the present invention each may be added to a layer in the image-recording layer side on the support, namely, an image-forming layer, or any other layers; however, the compounds each is preferably added to an image-forming layer or a layer adjacent thereto.

The addition amount of the compound represented by the formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

The compounds represented by formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Coating Nos. 9-354107, 9-309813 and 9-272002.

The compounds represented by the formulae (1) to (3) may be used individually or in combination of two or more thereof. In addition to these compounds, a compound described in U.S. Pat. Nos. 5,545,515, 5,635,339 and 5,654,130, International Patent Publication WO97/34196, U.S. Pat. No. 5,686,228 or Japanese Patent Coating Nos. 8-279962, 9-228881, 9-273935, 9-354107, 9-309813, 9-296174, 9-282564, 9-272002, 9-272003 and 9-332388 may also be used in combination. They can also be used in combination with such hydrazine derivatives as mentioned below.

The hydrazine derivative for use in the present invention as a core-forming agent is preferably a compound represented by the following general formula (H):

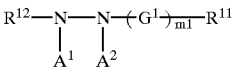

(H)

In the formula, R represents an aliphatic group, an aromatic group or a heterocyclic group, $R^{11}$ represents a hydrogen atom or a block group, $G^1$ represents —CO—, —COCO—, —C(=S)—, —$SO_2$—, —SO—, —PO($R^{13}$)— (wherein $R^{13}$ is a group selected from the groups within the range defined for $R^{11}$, and $R^3$ may be different from $R^{11}$), or an iminomethylene group, $A^1$ and $A^2$ both represents a hydrogen atom or one represents a hydrogen atom and the other represents a substituted or unsubstituted alkylsulfonyl group, a substituted or unsubstituted arylsulfonyl group, or a substituted or unsubstituted acyl group, and $m^1$ represents 0 or 1 and when $m^1$ is 0, $R^{11}$ represents an aliphatic group, an aromatic group or a heterocyclic group.

In the general formula (H), the aliphatic group represented by $R^{12}$ is preferably a substituted or unsubstituted, linear, branched or cyclic alkyl group, an alkenyl group or an alkynyl group having from 1 to 30 carbon atoms.

In the general formula (H), the aromatic group represented by $R^{12}$ is a monocyclic or condensed cyclic aryl group, and examples thereof include a phenyl group and a naphthalene group. The heterocyclic group represented by $R^{12}$ is a monocyclic or condensed cyclic, saturated or unsaturated, aromatic or non-aromatic heterocyclic group, and examples thereof include a pyridine ring, a pyrimidine ring, an imidazole ring, a pyrazole ring, a quinoline ring, an isoquinoline ring, a benzimidazole ring, a thiazole ring, a benzothiazole ring, a piperidine ring, a triazine ring, a morpholino ring, a piperidine ring and a piperazine ring.

$R^{12}$ is preferably an aryl group or an alkyl group.

$R^{12}$ may be substituted and representative examples of the substituent include a halogen atom (e.g., fluorine, chlorine, bromine, iodine), an alkyl group (including an aralkyl group, a cycloalkyl group and an active methine group), an alkenyl group, an alkynyl group, an aryl group, a heterocyclic group, a heterocyclic group containing a quaternized nitrogen atom (e.g., pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or a propylene oxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl orheterocyclic)amino group, a N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazide group, thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl) sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoramido or phosphoric acid ester structure.

These substituents each may further be substituted by any of the above-described substituents.

When $R^{12}$ represents an aromatic group or a heterocyclic group, the substituent of $R^{12}$ is preferably an alkyl group (including an active methylene group), an aralkyl group, a heterocyclic group, a substituted amino group, anacylamino group, a sulfonamido group, a ureido group, a sulfamoylamino group, an imido group, a thioureido group, a phosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic)thio group, a sulfo group (including a salt thereof), a sulfamoyl group, a halogen atom, a cyano group or a nitro group.

When $R^{12}$ represents an aliphatic group, the substituent is preferably an alkyl group, an aryl group, a heterocyclic group, an amino group, an acylamino group, a sulfonamido group, a ureido group, a sulfamoylamino group, an imido group, a thioureido group, a phosphoramido group, ahydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic)thio group, a sulfo group (including a salt thereof), a sulfamoyl group, a halogen atom, a cyano group or a nitro group.

In the formula (H), $R^{11}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R^{11}$ is preferably a substituted or unsubstituted alkyl group having from 1 to 10 carbon atoms, and examples thereof include a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a 3-methanesulfonamidopropyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group The alkenyl group is preferably an alkenyl group having from 1 to 10 carbon atoms, and examples thereof include a vinyl group, a 2-ethoxycarbonylvinyl group and a 2-trifluoro-2-methoxycarbonylvinyl group. The alkynyl group is an alkynyl group having from 1 to 10 carbon atoms, and examples thereof include an ethynyl group and a 2-methoxycarbonylethynyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group.

The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group (e.g., N-methyl-3-pyridinio group), a quinolinio group and a quinolyl group.

The alkoxy group is preferably an alkoxy group having from 1 to 8 carbon atoms, and examples thereof include a methoxy group, a 2-hydroxyethoxy group, a benzyloxy group and a t-butoxy group. The aryloxy group is preferably a substituted or unsubstituted phenoxy group, and the amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, an anilino group, an o-hydroxyanilino group, a 5-benzotriazolylamino group and a N-benzyl-3-pyridinioamino group. The hydrazino group is preferably a substituted or unsubstituted hydrazino group or a substituted or unsubstituted phenylhydrazino group (e.g., 4-benzenesulfonamidophenylhydrazino group).

The group represented by $R^1$ may be substituted, and examples of the substituent include those described as the substituent of $R^{12}$.

In the formula (H), $R^{11}$ may be one which cleaves the $G^1$—$R^{11}$ moiety from the residual molecule and causes a cyclization reaction to form a cyclic structure containing the atoms in the —$G^1$—$R^{11}$ moiety, and examples thereof include those described in JP-A-63-29751.

Into the hydrazine derivative represented by the formula (H), an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

In the formula (H), $R^{11}$ or $R^{12}$ may be one into which a ballast group or polymer commonly used in immobile photographic additives such as a coupler may be integrated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

In the formula (H), $R^1$ or $R^2$ may contain a plurality of hydrazino groups as the substituent. At this time, the compound represented by the formula (H) is a polymer product with respect to the hydrazino group, and specific examples thereof include the compounds described in JP-A-64-86134, JP-A-4-16938, JP-A-5-197091, WO95-32452, WO95-32453, Japanese Patent Coating Nos. 7-351132, 7-351269, 7-351168, 7-351287 and 9-351279.

In the formula (H), $R^{11}$ or $R^{12}$ may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group). Examples of the compound containing such a group include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

In the formula (H), $A^1$ and $A^2$ each represents a hydrogen atom, an alkyl- or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of Hammett's substituent constants is −0.5 or more, or a linear, branched or cyclic, substituted or unsubstituted aliphatic acyl group (examples of the substituent include a halogen atom, an ether group, a sulfonamido group, a carbonamido group, a hydroxy group, a carboxy group and a sulfo group)).

$A^1$ and $A^2$ each is most preferably a hydrogen atom.

A particularly preferred embodiment of the hydrazine derivative for use in the present invention is described below.

$R^{12}$ is preferably a phenyl group or a substituted alkyl group having from 1 to 3 carbon atoms.

When $R^{12}$ represents a phenyl group, the substituent therefor is preferably a nitro group, an alkoxy group, an alkyl group, an acylamino group, a ureido group, a sulfonamido group, a thioureido group, a carbamoyl group, a sulfamoyl group, a carboxy group (or a salt thereof), a sulfo group (or a salt thereof), an alkoxycarbonyl group or a chlorine atom.

When $R^{12}$ represents a substituted phenyl group, the substituent is preferably substituted directly or through a linking group by at least one of a ballast group, an adsorptive group to silver halide, a group containing a quaternary ammonio group, a nitrogen-containing heterocyclic group containing a quaternized nitrogen, a group containing an ethyleneoxy group as a repeating unit, an (alkyl, aryl or heterocyclic)thio group, a nitro group, an alkoxy group, an acylamino group, a sulfonamido group, a dissociative group (e.g., carboxy group, sulfo group, acylsulfamoyl group, carbamoylsulfamoyl group) and a hydrazino group capable of forming a polymer product (a group represented by —NHNH—$G^1R^{11}$).

When $R^{12}$ represents a substituted alkyl group having from 1 to 3 carbon atoms, $R^{12}$ is more preferably a substituted methyl group, more preferably a disubstituted or trisubstituted methyl group, and the substituent therefor is preferably a methyl group, a phenyl group, a cyano group, an (alkyl, aryl or heterocyclic)thio group, an alkoxy group, an aryloxy group, a chlorine atom, a heterocyclic group, an alkoxycarbonyl group, an aryloxycarbonyl group, a carbamoyl group, a sulfamoyl group, an amino group, an acylamino group or a sulfonamido group, more preferably a substituted or unsubstituted phenyl group.

When $R^{12}$ represents a substituted methyl group, $R^{12}$ is preferably a t-butyl group, a dicyanomethyl group, a dicyanophenylmethyl group, a triphenylmethyl group (trityl group), a diphenylmethyl group, a methoxycarbonyldiphenylmethyl group, a cyanodiphenylmethyl group, a methylthiodiphenylmethyl group or a cyclopropyldiphenylmethyl group, most preferably a trityl group.

In the formula (H), $R^{12}$ is most preferably a substituted phenyl group.

In the formula (H), $m^1$ represents 1 or 0. When $m^1$ is 0, $R^{11}$ is an aliphatic group, an aromatic group or a heterocyclic group, preferably a phenyl group or a substituted alkyl group having from 1 to 3 carbon atoms, and these groups have the same preferred range as described above for $R^{12}$.

$m^1$ is preferably 1.

The preferred embodiment of the group represented by $R^{11}$ is described below. When $R^{12}$ is a phenyl group and $G^1$ is —CO— group, $R^{11}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{11}$ represents an alkyl group, the substituent therefor is preferably a halogen atom, an alkoxy group, an aryloxy group, an alkylthio group, an arylthio group or a carboxy group.

When $R^{12}$ is a substituted methyl group and $G^1$ is —CO— group, $R^{11}$ is preferably a hydrogen atom, an alkyl group, an aryl group, a heterocyclic group, an alkoxy group or an amino group (e.g., unsubstituted amino group, alkylamino group, arylamino group, heterocyclic amino group), more preferably a hydrogen atom, an alkyl group, an aryl group, a heterocyclic group, an alkoxy group, an alkylamino group, an arylamino group or a heterocyclic amino group. When $G^1$ is —COCO— group, $R^{11}$ is preferably, irrespective of $R^{12}$, an alkoxy group, an aryloxy group or an amino group, more preferably a substituted amino group, specifically, an alkylamino group, an arylamino group or a saturated or unsaturated heterocyclic amino group.

When $G^1$ is —$SO_2$— group, $R^{11}$ is preferably, irrespective of $R^{12}$, an alkyl group, an aryl group or a substituted amino group.

In the formula (H), $G^1$ is preferably —CO— or —COCO— group, more preferably —CO— group.

Specific examples of the compound represented by the formula (H) are shown below. However, the present invention is by no means limited to those compounds.

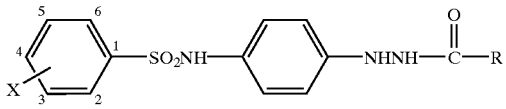

| | X = | R = —H | —$C_2F_4$—COOH or (—$C_2F_4$—$COO^{\ominus}K^{\oplus}$) | 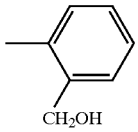 | —CONH— 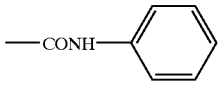 |
|---|---|---|---|---|---|
| 1 | 3-NHCO—$C_9H_{19}$(n) | 1a | 1b | 1c | 1d |
| 2 | 3-NHCONH 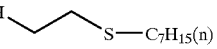 | 2a | 2b | 2c | 2d |
| 3 | 3-$NHCOCH_2$— 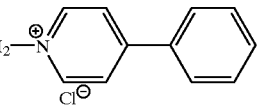 | 3a | 3b | 3c | 3d |
| 4 | 3-$NHCOCH_2$— 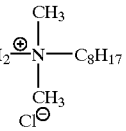 | 4a | 4b | 4c | 4d |
| 5 | 3-NHCO— 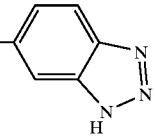 | 5a | 5b | 5c | 5d |

-continued
| | | | | | |
|---|---|---|---|---|---|
| 6 | 3-NHCONH— 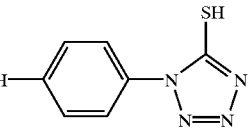 | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |
| | | R = | | | |
| | X = | —H | —$CF_2H$ | —$CH_2$— 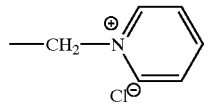 | —CONH— 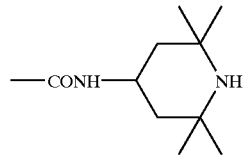 |
| 8 | 3-$CONHCH_2CH(C_2H_5)C_4H_9$ | 8a | 8e | 8f | 8g |
| 9 | 6-$OCH_3$-3-$C_5H_{11}$(t) | 9a | 9e | 9f | 9g |
| 10 | 3- 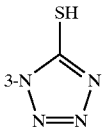 | 10a | 10e | 10f | 10g |
| 11 | 3-$NHCOCH_2SCH$ 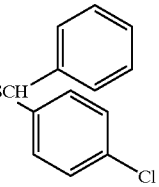 | 11a | 11e | 11f | 11g |
| 12 | 4-$NHCOCH_2$—S— 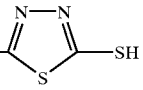 | 12a | 12e | 12f | 12g |
| 13 | 3-$NHCOCH(CH_2COOH)$—$C_8H_{17}$ | 13a | 13e | 13f | 13g |
| 14 | 3,5-$(CONHCH_2CH(C_2H_5)C_4H_9)_2$ | 14a | 14e | 14f | 14g |
| | 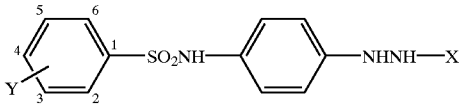 | | | | |
| | | X = | | | |
| | Y = | —CHO | —$COCF_3$ | —$SO_2CH_3$ | —$P(=O)(OC_2H_5)_2$ |
| 15 | 3- 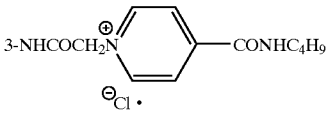 | 15a | 15h | 15i | 15j |

-continued

| | | | | | |
|---|---|---|---|---|---|
| 16 | 4-NHCO$(CH_2)_2$N$^{\oplus}$—$C_6H_{13}$ $Cl^{\ominus}$ | 16a | 16h | 16i | 16j |
| 17 | 3-$SO_2$NH—$(CH_2)_4$—O—$OC_4H_9$ | 17a | 17h | 17i | 17j |
| 18 | 3,4-(COOCH(CH$_3$)COO$C_4H_9$)$_2$ | 18a | 18h | 18i | 18j |
| 19 | 3-NHCO— (1,2-dithiolane) | 19a | 19h | 19i | 19j |
| 20 | 3-$NHSO_2NH$—$C_8H_{17}$ | 20a | 20h | 20i | 20j |
| 21 | 2-Cl-5-N (1,3,4-thiadiazole, SH) | 21a | 21h | 21i | 21j |

| | | R = | | | |
|---|---|---|---|---|---|
| | | —H | —$CF_3$ | —$CH_2$—(2,4-dichlorophenol) | —CONH—$CH_2CH_2$—OH |
| 22 | (benzotriazole)—$SO_2NH$—(phenyl)—NHNH—C(=O)—R | 22a | 22h | 22k | 22l |
| 23 | ($C_4H_9CH(C_2H_5)CH_2NHCONH$)(OH)(OH)—S—(tetrazole)—(phenyl)—$SO_2NH$—(phenyl)—NHNH—C(=O)—R | 23a | 23h | 23k | 23l |

-continued
| | | | | |
|---|---|---|---|---|
| 24 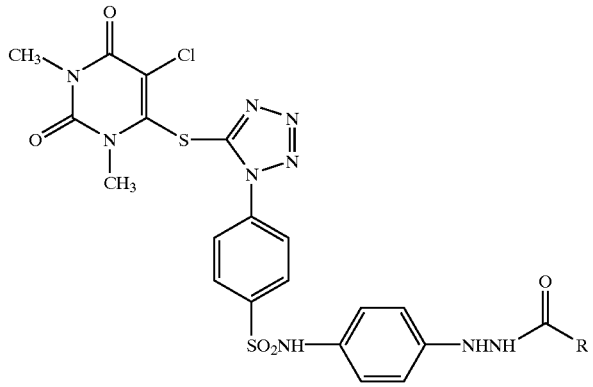 | 24a | 24h | 24k | 24l |
| 25 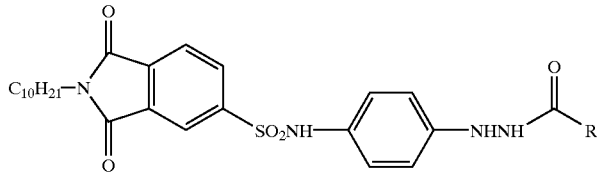 | 25a | 25h | 25k | 25l |
| 26 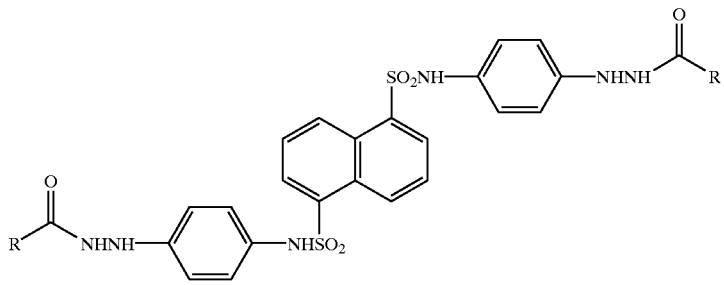 | 26a | 26h | 26k | 26l |
| 27 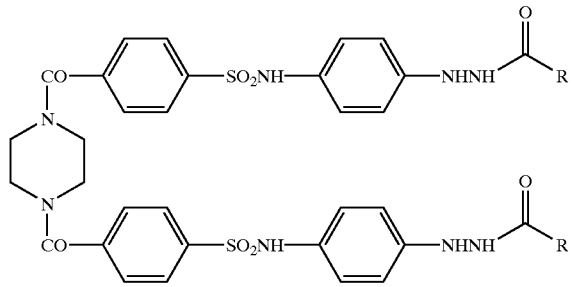 | 27a | 27h | 27k | 27l |
| 28 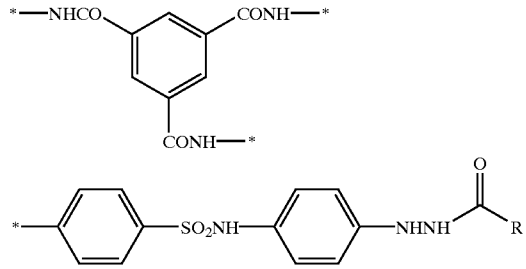 | 28a | 28h | 28k | 28l |

-continued
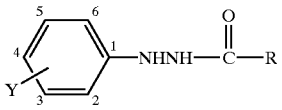
| | Y = | R = —H | —$CH_2OCH_3$ | 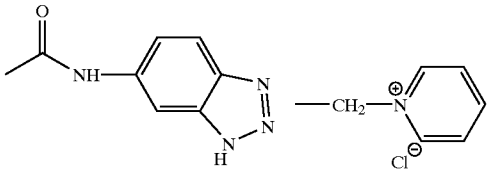 | |
|---|---|---|---|---|---|
| 29 | 4-NHC(=S)NH—$C_8H_{17}$(n) | 29a | 29m | 29n | 29f |
| 30 | 4-NHP(=O)(OCH$_2$—Ph)$_2$ | 30a | 30m | 30n | 30f |
| 31 | 4-NHCONH—$(CH_2)_3$O—Ph—C(CH$_3$)$_3$ | 31a | 31m | 31n | 31f |
| 32 | 4-OH<br>3-NHCONHCH$_2$CH($C_2H_5$)—$C_4H_9$ | 32a | 32m | 32n | 32f |
| 33 | 4-NHSO$_2$(CH$_2$)$_2$NHCO—Ph— 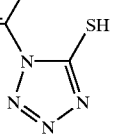 | 33a | 33m | 33n | 33f |
| 34 | 4-OCH$_2$—Ph | 34a | 34m | 34n | 34f |
| 35 | 4-NHCONHN—CH$_2$—Ph)$_2$ | 35a | 35m | 35n | 35f |
| | Y = | R = —H | —$CF_2SCH_3$ | —$CONHCH_3$ | 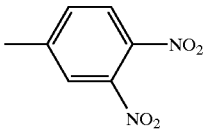 |
|---|---|---|---|---|---|
| 36 | 2-NHSO$_2$CH$_3$—<br>4-NHCONH(CH$_2$)$_3$— 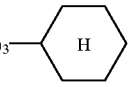 | 36a | 36o | 36p | 36q |
| 37 | 2-OCH$_3$—<br>4-NHSO$_2$C$_{12}$H$_{25}$ | 37a | 37o | 37p | 37q |

-continued
| | | | | | |
|---|---|---|---|---|---|
| 38 | 3-$NHCOC_{11}H_{23}$—<br>4-$NHSO_2CF_3$ | 38a | 38o | 38p | 38q |
| 39 | 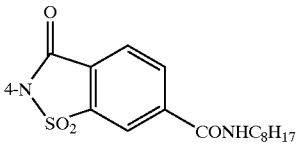 | 39a | 39o | 39p | 39q |
| 40 | 4-$OCO(CH_2)_2COOC_6H_{13}$ | 40a | 40o | 41p | 41q |
| 41 | 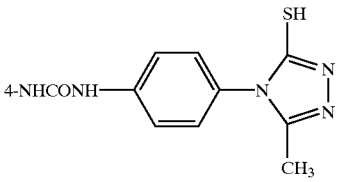 | 41a | 41o | 41p | 41q |
| 42 | 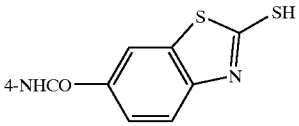 | 42a | 42o | 42p | 42q |
43
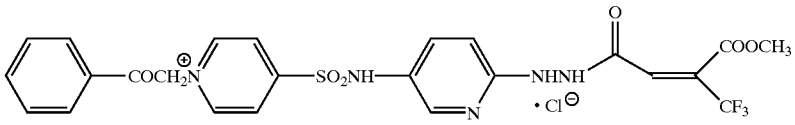
44
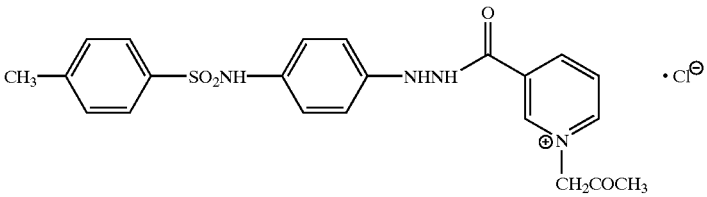
45
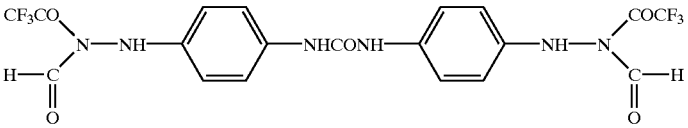
46
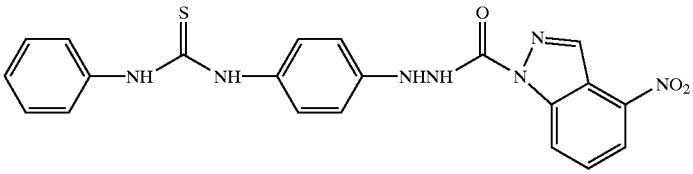
47
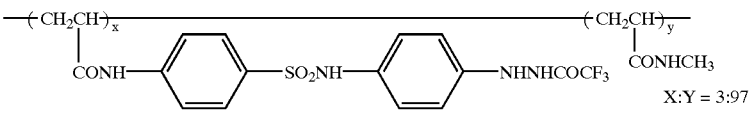
X:Y = 3:97
MW ≒ 100,000
48
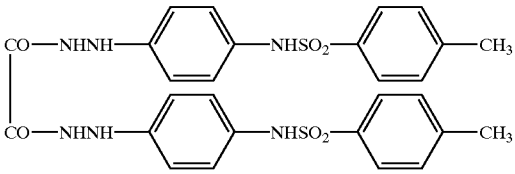

-continued
49
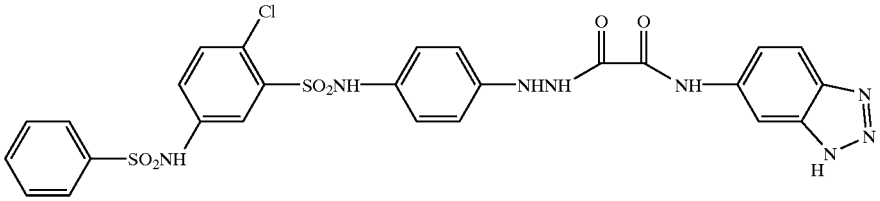
50
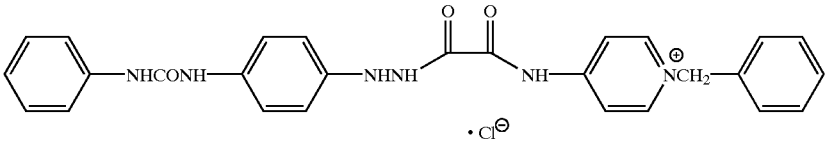
51
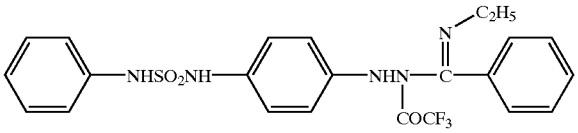
52
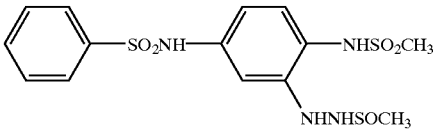
53
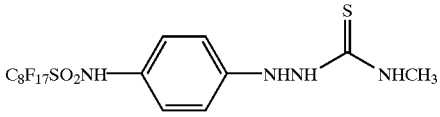
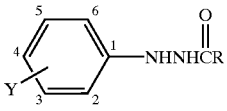
| | R = | | | |
|---|---|---|---|---|
| Y = | —H | —$CH_2OCH_3$ | —$CH_2O$— 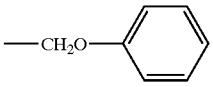 | —$CONHC_3H_7$ |
| 54 2-$OCH_3$ | 54a | 54m | 54r | 54s |
| 55 2-$OCH_3$ 5-$C_8H_{17}$(t) | 55a | 55m | 55r | 55s |
| 56 4-$NO_2$ | 56a | 56m | 56r | 56s |
| 57 4-$CH_3$ | 57a | 57m | 57r | 57s |
| 58 4-NHCO— 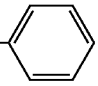 | 58a | 58m | 58r | 58s |
| 59 4-NHCN(O)($CH_2$— 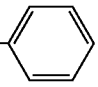 )($CH_2$— 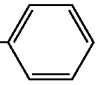 ) | 59a | 59m | 59r | 59s |

-continued
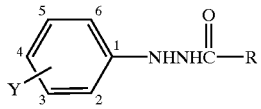
| | R = | | | |
|---|---|---|---|---|
| Y = | —H | 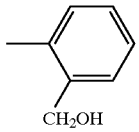 | 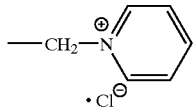 | 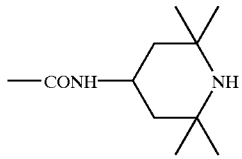 |
| 60 2-$OCH_3$ 5-$OCH_3$ | 60a | 60c | 60f | 60g |
| 61 4-$C_8H_{17}$(t) | 61a | 61c | 61f | 61g |
| 62 4-$OCH_3$ | 62a | 62c | 62f | 62g |
| 63 3-$NO_2$ | 63a | 63c | 63f | 63g |
| 64 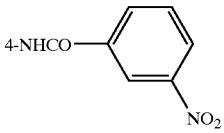 | 64a | 64c | 64f | 64g |
| 65 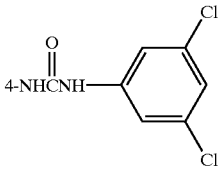 | 65a | 65c | 65f | 65g |
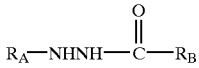
| | $R_B$ = | | | |
|---|---|---|---|---|
| $R_A$ = | —H | 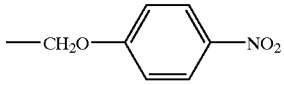 | 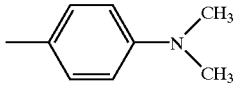 | 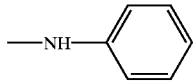 |
| 66 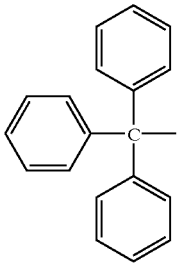 | 66a | 66u | 66v | 66t |

-continued
| | | | | |
|---|---|---|---|---|
| 67 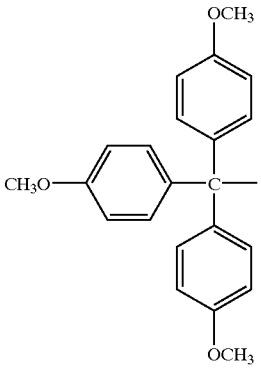 | 67a | 67u | 67v | 67t |
| 68 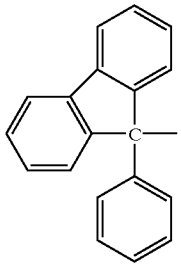 | 68a | 68u | 68v | 68t |
| 69 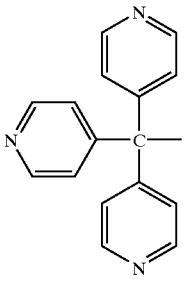 | 69a | 69u | 69v | 69t |
| 70 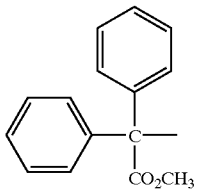 | 70a | 70u | 70v | 70t |
| 71 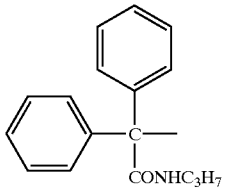 | 71a | 71u | 71v | 71t |

-continued
| | $R_A$ = | $R_B$ = $-\overset{O}{\overset{\|\|}{C}}NHC_3H_7$ | $-\overset{O}{\overset{\|\|}{C}}O-C_4H_9(t)$ | $-OC_4H_9(t)$ | 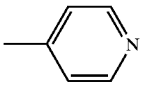 |
|---|---|---|---|---|---|
| 72 | 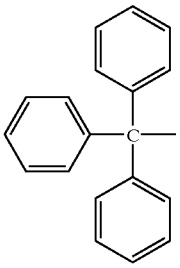 | 72s | 72x | 72y | 72w |
| 73 | 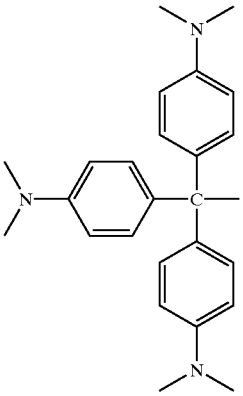 | 73s | 73x | 73y | 73w |
| 74 | 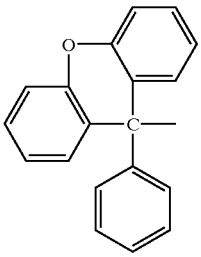 | 74s | 74x | 74y | 74w |
| 75 | 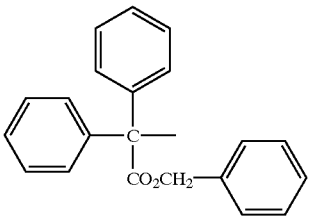 | 75s | 75x | 75y | 75w |
| 76 | 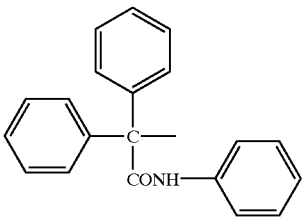 | 76s | 76x | 76y | 76w |

-continued
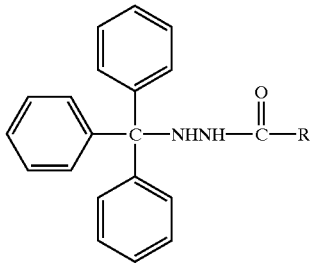
R =
77
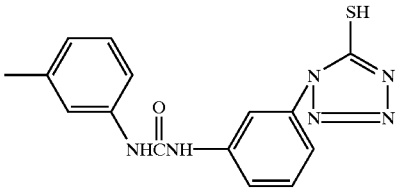
78
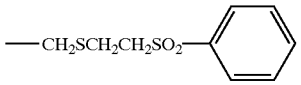
79 —$CH_2OCH_2CH_2SCH_2CH_2OCH_3$
80 —$CF_2CF_2COOH$
81
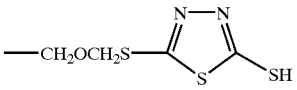
82
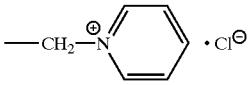
83
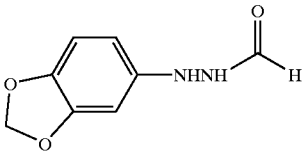
84
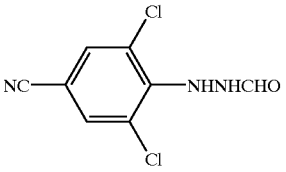
85
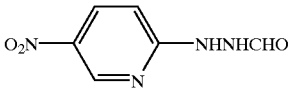
86
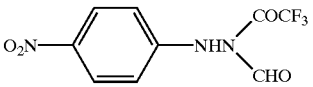
87
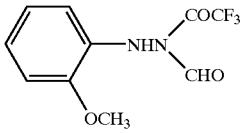

-continued
88
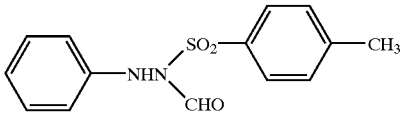
89
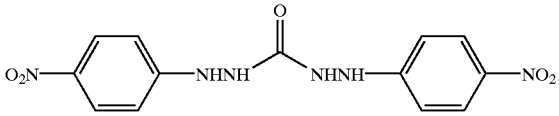
90
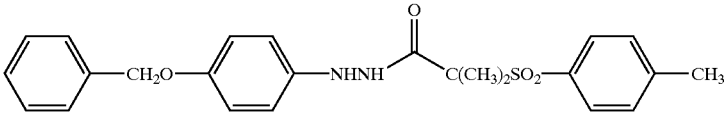
91
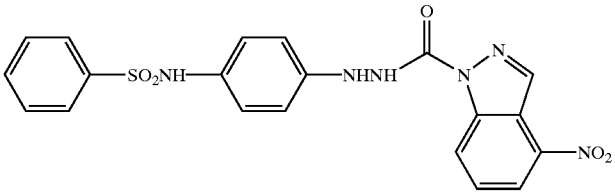
92
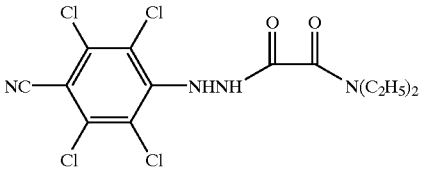
93
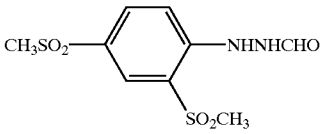
94
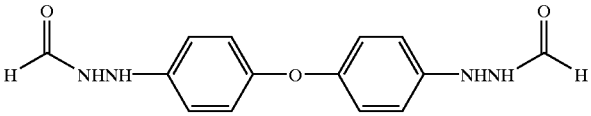
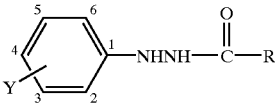
| | R = | | | |
|---|---|---|---|---|
| Y = | 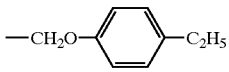 | 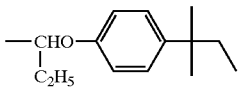 | 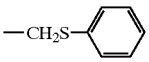 |  |
| 95 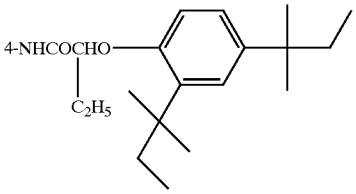 | 95-1 | 95-2 | 95-3 | 95-4 |
| 96 4-COOH | 96-1 | 96-2 | 96-3 | 96-4 |

-continued
| | | | | | |
|---|---|---|---|---|---|
| 97 | 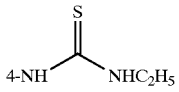 | 97-1 | 97-2 | 97-3 | 97-4 |
| 98 | 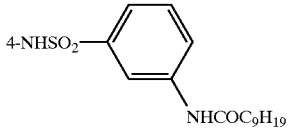 | 98-1 | 98-2 | 98-3 | 98-4 |
| 99 | 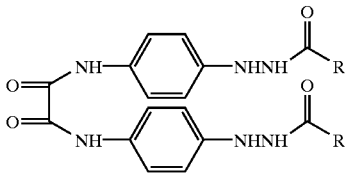 | 99-1 | 99-2 | 99-3 | 99-4 |
| 100 | 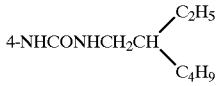 | 100-1 | 100-2 | 100-3 | 100-4 |
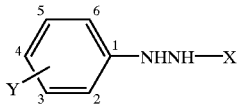
X =
| Y = | | | | |
|---|---|---|---|---|
| 101 4-$NO_2$ | 101-5 | 101-6 | 101-7 | 101y |
| 102 2,4-$OCH_3$ | 102-5 | 102-6 | 102-7 | 102y |
| 103 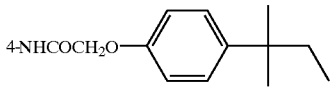 | 103-5 | 103-6 | 103-7 | 103y |
X =
| Y = | | | | |
|---|---|---|---|---|
| 104 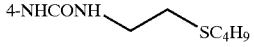 | 104-8 | 104-9 | 104w' | 104x |
| 105 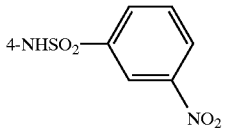 | 105-8 | 105-9 | 105w' | 105x |

-continued
| | Y—NHNH—X | | | |
|---|---|---|---|---|
| | X = | | | |
| Y = | 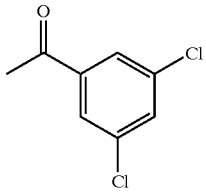 | 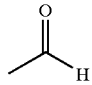 | 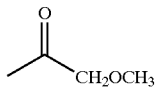 | 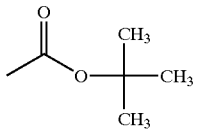 |
| 106 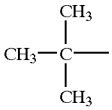 | 106-10 | 106a | 106m | 106y |
| 107 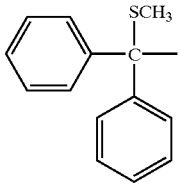 | 107-10 | 107a | 107m | 107y |
| 108 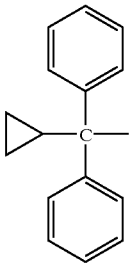 | 108-10 | 108a | 108m | 108y |
| 109 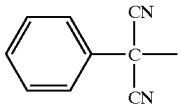 | 109-10 | 109a | 109m | 109y |
| 110 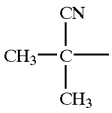 | 110-10 | 110a | 110m | 110y |
| 111 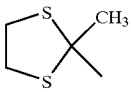 | 111-10 | 111a | 111m | 111y |

-continued
| | Y—NHNH—X | | | |
|---|---|---|---|---|
| | X = | | | |
| Y = | 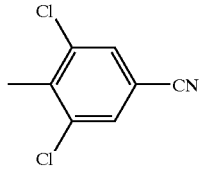 | 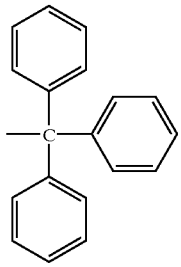 | 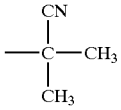 | 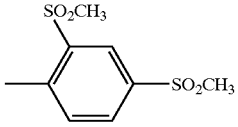 |
| 112 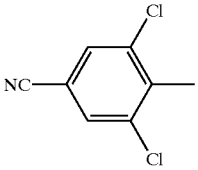 | 112-11 | 112-12 | 112-13 | 112-14 |
| 113 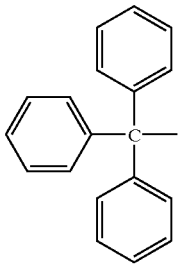 | 113-11 | 113-12 | 113-13 | 113-14 |
| 114 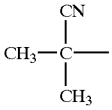 | 114-11 | 114-12 | 114-13 | 114-14 |
| 115 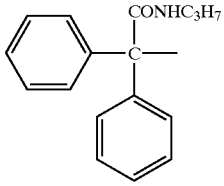 | 115-11 | 115-12 | 115-13 | 115-14 |
| 116 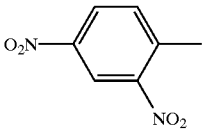 | 116-11 | 116-12 | 116-13 | 116-14 |
| 117 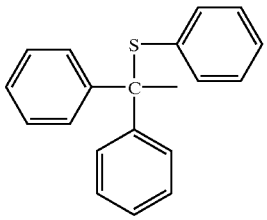 | 117-11 | 117-12 | 117-13 | 117-14 |

-continued
118
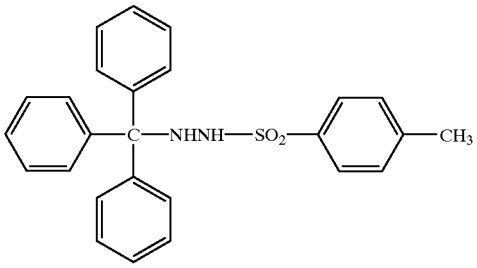
119
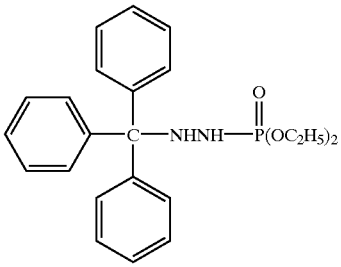
120
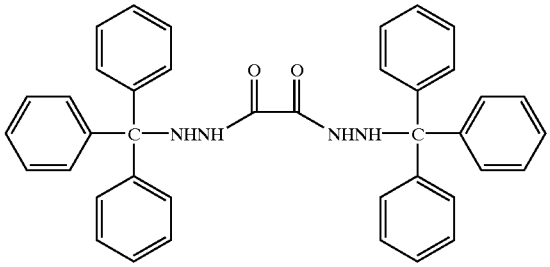
121
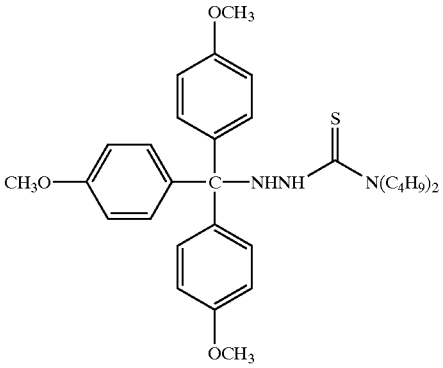
122
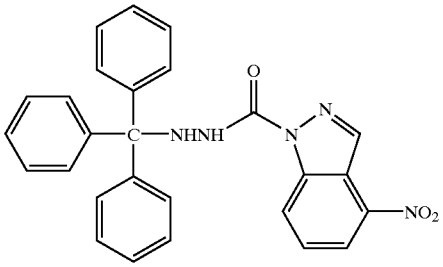

-continued
| | |
|---|---|
| 123 | 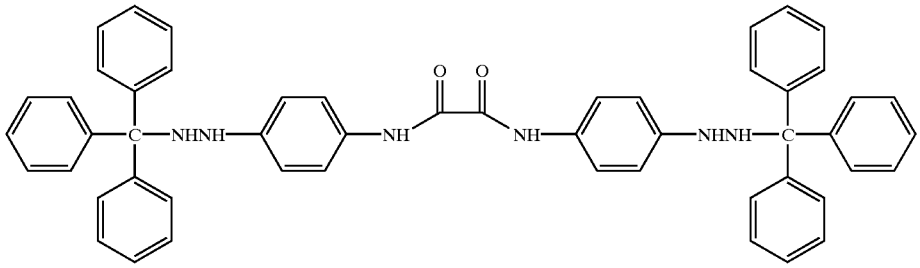 |
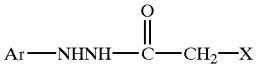
| | Ar = | X = —OH | —SH | —NHCOCF$_3$ | —NHSO$_2$CH$_3$ | —NHSO$_2$ph | —N(CH$_3$)$_2$ |
|---|---|---|---|---|---|---|---|
| 124 | 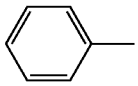 | 124a | 124b | 124c | 124d | 124e | 124f |
| 125 | 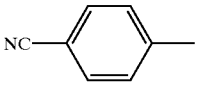 | 125a | 125b | 125c | 125d | 125e | 125f |
| 126 | 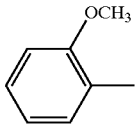 | 126a | 126b | 126c | 126d | 126e | 126f |
| 127 | 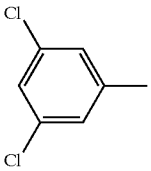 | 127a | 127b | 127c | 127d | 127e | 127f |
| 128 | 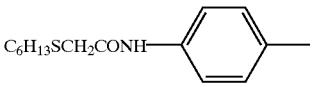 | 128a | 128b | 128c | 128d | 128e | 128f |
| 129 | 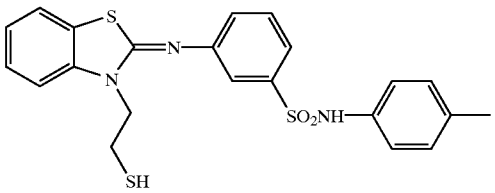 | 129a | 129b | 129c | 129d | 129e | 129f |
| 130 | 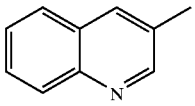 | 130a | 130b | 130c | 130d | 130e | 130f |
| 131 | 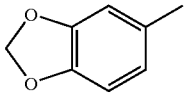 | 131a | 131b | 131c | 131d | 131e | 131f |

-continued

| | | | | | | | |
|---|---|---|---|---|---|---|---|
| 132 | 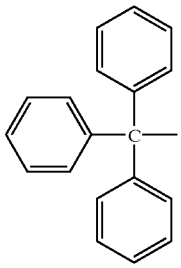 | 132a | 132b | 132c | 132d | 132e | 132f |
| 133 | 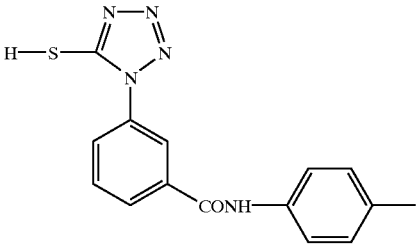 | 133a | 133b | 133c | 133d | 133e | 133f |
| 134 | 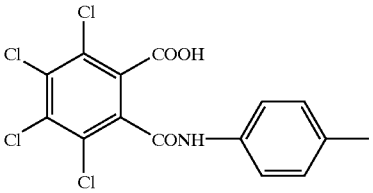 | 134a | 134b | 134c | 134d | 134e | 134f |
| 135 | 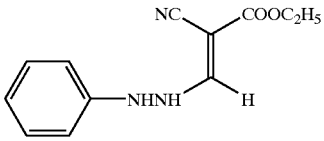 | | | | | | |
| 136 | 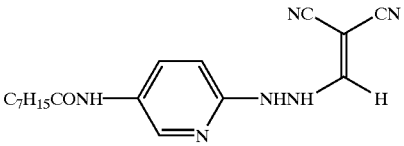 | | | | | | |
| 137 | 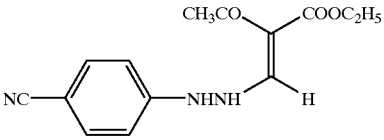 | | | | | | |

In addition to the above-described hydrazine derivatives, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

Examples of the hydrazine derivative other than the hydrazine derivative described in the foregoing include the compounds represented by (Chem. 1) of JP-B-6-77138, specifically, compounds described at pages 3 and 4 of the publication; the compounds represented by the formula (I) of JP-B-6-93082, specifically, Compounds 1–38 described at pages 8 to 18 of the publication; the compounds represented by the formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulae (1) and (2) of JP-A-6-289520, specifically, Compounds 1-1) to 1-17) and 2-1) describedatpages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulae (H) and (Ha) of JP-A-

7-104426, specifically, Compounds H-1 to H-44 described at pages 8 to 15 of the publication; the compounds characterized by having in the vicinity of the hydrazine group an anionic group or a nonionic group capable of forming an internal hydrogen bond with a hydrogen atom of hydrazine, described in JP-A-9-22082, particularly, the compounds represented by the formulae (A), (B), (C), (D), (E) and (F), specifically, Compounds N-1 to N-30 described in the publication; the compound represented by the formula (1) described in JP-A-9-22082, specifically, Compounds D-1 to D-55 described in the publication; various hydrazine derivatives described at pages 25 to 34 of *Kochi Gijutsu* (*Known Techniques*), pages 1 to 207, Aztech (issued on March 22, 1991); and Compounds D-2 and D-39 described in JP-A-62-86354 (pages 6 and 7).

The hydrazine core-forming agent for use in the present invention may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine derivatives for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in water by a method known as a solid dispersion method, using a ball mill, colloid mill or ultrasonic wave.

The hydrazine core-forming agent for use in the present invention may be added to any layers on the image-forming layer side on the support, i.e., the image-forming layer or other layers on that layer side; however, they are preferably added to an image-forming layer or a layer adjacent thereto.

The addition amount of the hydrazine core-forming agent for use in the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver.

In the present invention, a contrast accelerator may be used in combination with the above-described core-forming agent (ultrahigh contrast agent) so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

The synthesis methods, addition methods and addition amounts of the aforementioned core forming agents (ultrahigh contrast agents) and the contrast accelerators may be according to those described in the patent publications cited above.

The heat-developable image-recording material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He—Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine andmerocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international coating published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in *Research Disclosure,* Vol. 176, 17643, page 23, Item IV-J (December, 1978), JP-B-49-25500, JP-B-43-4933, JP-A-59-19032, JP-A-59-192242 and the like.

The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the image-forming layer (photosensitive layer).

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-6-208193, JP-A-7-5621, JP-A-7-2781, JP-A-8-15809 and U.S. Pat. Nos. 5,340,712, 5,369,000 and 5,464,737.

The antifoggant for use in the present invention may be added in any form of a solution, powder, solid microparticle dispersion and the like. In case of the water-insoluble substance, however, it is preferably added in the form of solid microparticle dispsersions with water acting as a dispersion solvent. The solid microparticle dispersion is performed using a known pulverization means (e.g., ballmill, vibrating ballmill, sandmill, colloid mill, jet mill, roller mill). At the time of solid microparticle dispersion, a dispersion aid may also be used.

Although not essential for practicing the present invention, it is advantageous in some cases to add a mercury (II) salt as an antifoggant to the emulsion layer. Preferred mercury(II) salts for this purpose are mercury acetate and mercury bromide. The addition amount of mercury for use in the present invention is preferably from $1\times10^{-9}$ to $1\times10^{-3}$ mol, more preferably from $1\times10^{-8}$ to $1\times10^{-4}$ mol, per mol of silver coated.

The heat-developable image-recording material in the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the image-forming material, but the layer to which the benzoic acid is added is preferably a layer on the surface having the image-forming layer (a photosensitive layer), more preferably an organic silver salt-containing layer. The benzoic acid compound for use in the present invention may be added at any step during the preparation of the coating solution. In the case of adding the benzoic acid compound to an organic silver salt-containing layer, it may be added at any step from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention maybe added in any amount; however, the addition amount thereof is preferably from $1\times10^{-6}$ to 2 mol, more preferably from $1\times10^{-3}$ to 0.5 mol, per mol of silver.

The heat-developable image-recording material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may contain substituted groups). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)-benzenesulfonate, N-methyl-N'-{3-(5-mercaptotetrazolyl)phenyl}urea 2-mercapto-4-phenyloxazole and the like. However, the present invention is by no means limited thereto.

The amount of the mercapto compound added is preferably from 0.0001 to 1.0 mol, more preferably from 0.001 to 0.3 mol, per mol of silver in an emulsion layer (image-forming layer).

The image-forming layer for use in the present invention may contain a plasticizer or lubricant, and examples thereof include polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

Although in the present invention the image-forming layer coating liquid has a PH regulated to the range of 5.5 to 7.8,8, the acid for use in this regulation is preferably an acid not containing any halogen.

The heat-developable image-recording material of the present invention is preferably a so-called single-sided image-recording material comprising a support having on one side thereof at least one image-forming layer containing a silver halide emulsion and on the other side thereof a back layer.

In the present invention, the back layer preferably has a maximum absorption in a desired range of from about 0.3 to 2.0. In the case of the desired range of 750 to 1400 nm, it is preferably an antihalation layer having an optical density of preferably 0.005 or more but less than 0.5 at 750 to 360 nm, more preferably 0.001 or more but less than 0.3. In the case of the desired range of 750 nm or less, it is preferably an antihalation layer having the pre-image-formation maximum absorption in the desired range of 0.3 to 2.0 inclusive and having the post-image-formation optical density of 0.005 or more but less than 0.3 at 360 to 750 nm. No limitation is particularly imposed on the method of lowering the post-image-formation optical density to the above range, although examples can be a method as described in BE patent No. 733, 706 in which the dye-based density is lowered through decoloration by heating, and a method as described in JP-A-54-17833 in which the density is lowered through decoloration by light irradiation.

In the case when an antihalation dye is used in the present invention, such a dye may be any compound so long as the compound has an objective absorption in the desired region, the absorption in the visible region can be sufficiently reduced after the processing, and the back layer can have a preferred absorption spectrum form. While examples thereof include those described in the following patent publications, the present invention is by no means limited thereto: as a dye which is used alone, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

The heat-developable photographic emulsion for use in the present invention is coated on a support to form one or more layers. In the case of a single-layer structure, the layer must contain an organic silver salt, a silver halide, a developer, a binder and additional desired materials such as a color toner, a coating aid and other auxiliary agents. In the case of a two-layer structure, the first emulsion layer (usually a layer adjacent to the substrate) must contain an organic silver salt and a silver halide and the second layer or both layer must contain some other components. However, a two-layer structure constituted by a single emulsion layer containing all components and a protective topcoat may also be used. A multi-color photosensitive heat-developable photographic material may have a structure such that a combination of the above-described two layers is provided for respective colors, or, as described in U.S. Pat. No. 4,708,928, a structure such that a single layer contains all components. In the case of a multi-dye multi-color photosensitive heat-developable photographic material, respective emulsion layers (photosensitive layers) are generally kept away from each other by using a functional or non-functional barrier layer between respective photosensitive layers as described in U.S. Pat. No. 4,460,681.

A backside resistive heating layer described in U.S. Pat. Nos. 4,460,681and 4,374,921 may also be used in the photosensitive heat-developable photographic image system.

In the present invention, the layers such as the image-forming layer, protective layer and back layer each may contain a hardening agent. Examples of the hardening agent include polyisocyanates described in U.S. Pat. No. 4,281,060 and JP-A-6-208193, epoxy compounds described in U.S. Pat. No. 4,791,042, and vinyl sulfone-based compounds described in JP-A-62-89048.

Surfactants can be added to the heat-developable image-recording material according to the present invention in order to improve, for example, applicability and electrification property. The surfactants includes nonionic, anionic, and fluorinated ones. Fluorinated polymer surfactants are disclosed, for example, in JP-A-62-170950 and U.S. Pat. No. 5,380,644. Polysiloxane-based surfactants are disclosed, for example, in U.S. Pat. No. 3,885,965. Polyalkylene oxides and anionic surfactants are disclosed, for example, in JP-A-6-301140.

The thermal image-recording material according to the present invention can have, to prevent electrification, for example, a layer containing a soluble salt (e.g., chloride and nitrate), a metal-deposited layer, a layer containing an ionic polymer (See, for example U.S. Pat. Nos. 2,861,056 and 3,06,312), a layer containing an insoluble inorganic salt (See, for example, U.S. Pat. No. 3,428,451), and a layer containing, for example, tin oxide fine particles (See JP-A-60-252349 and JP-A-57-104931).

To obtain a color image using the thermal image-recording material according to the present invention, a method can be used which is described in JP-A-7-13295, p.10, left column, line 43 to p.11, left column, line 40. Stabilizers for color dye image are exemplified in British Patent 1,326,889, U.S. Pat. Nos. 3,432,300, 3,698,909, 3,574,627, 3,573,050, 3,764,337 and 4,042,394.

The photographic emulsion for heat development according to the present invention can be coated by various procedures including dip coating, air knife coating, flow coating, and extrusion coating using a hopper described in U.S. Pat. No. 2,681,294. Two or more layers can be coated by the methods described in U.S. Pat. No. 2,761,791 and GB Patent No. 837,095, if desired.

In the heat-developable image-recording material according to the present invention, additional layer(s) can be included such as a dye-receiving layer to receive a mobile dye image, an opacifying layer if the reflection print is desired, a protecting top coat layer, and a primer layer known in the thermal photography. It is preferable that the image-recording material per se, according to the present invention, can form image. It is not preferable that a functional layer which is necessary to form image such as an image-receiving layer is not included in other material.

The image-recording material of the present invention may be light-exposed by any method but the light source for the exposure is preferably a laser ray. The laser ray for use in the present invention is preferably one from a gas laser, YAG laser, dye laser, semiconductor laser or the like. The semiconductor laser and a second harmonic generation device may be used in combination.

The image-recording material of the present invention has a low haze at the exposure and is liable to incur generation of interference fringes. For preventing the generation of interference fringes, a technique of entering a laser ray obliquely with respect to the image-recording material disclosed in JP-A-5-113548 and a method of using a multimode laser disclosed in International Patent Publication WO95/31754 are known and these techniques are preferably used.

The image-recording material of the present invention is preferably exposed such that the laser rays are overlapped and the scanning lines are not viewed as described in *SPIE,* Vol. 169, "Laser Printing", pages 116 to 128 (1979), JP-A-4-51043 and WO95/31754.

The heat-developable image-recording material according to the present invention is usually developed by heating the image-recording material which was exposed to the light imagewisely. Developing temperature is preferably 80–250° C., more preferably 100–140° C. Developing time is preferably 1–180 sec, more preferably 10–90 sec.

In order to prevent irregular treatment caused by thermal shrinkage during heat development of the thermal image-recording material according to the present invention, multi-step heating is effective, i.e., image-forming is carried out by heating at 80° C. or higher, but lower than 115° C. (preferably 113° C. or lower) for 5 sec or longer without forming image, followed by thermally developing at 110° C. or higher (preferably at 130° C. or lower).

The heat development apparatus (heat developer) according to the present invention transports the heat-developable image-recording by driving the side having an image-forming layer of the heat-developable image-recording material with rollers and by sliding the opposite side (back surface) on the smooth surface.

FIG. 1 illustrates a side view of an example of constitution of the heat developer used in heat development of the thermal image-recording material according to the present invention. The heat developer in FIG. 1 has pairs of carrying-in rollers 11 (the lower rollers are heating rollers) which carry a thermal image-recording material 10 in a heating part with correcting said material flat and preheating, and pairs of carrying-out rollers 12 which carry out the heat-developable image-recording material 10 after heat development from the heating part with correcting said material flat. The heat-developable image-recording material 10 is thermally developed during transportation from the pair of carrying-in rollers 11 to the pair of carrying-out rollers 12. For transporting the heat development photosensitive material 10 during the heat development, a plurality of rollers 13 are placed on the side contacting with the surface having an image-forming layer and the smooth surface 14 on which unwoven cloth or the like is pasted is placed on the side which contacts with the opposite side (back surface). A heat-developable image-recording material 10 is transported by being driven by a plurality of rollers 13 which contact with the surface having an image-forming layer with the back surface sliding on the smooth surface 14. For heating, a heater 15 is placed in the upper part of rollers 13 and in the lower part of the smooth surface 14 so that both sides of a thermal image-recording material are heated, using, for example, a plate heater. The clearance between rollers 13 and the smooth surface 14 is adjusted, preferably to 0–1 mm, so that a heat-developable image-recording material 10 can be transported although it depends on the material of the smooth surface.

Although any material can be used for the surface of rollers 13 and for the smooth surface 14 as long as it is tolerant to high temperature and it does not cause trouble in the transport of the heat-developable image-recording material 10, it is preferable that the material for the surface of the rollers is silicone rubber; that of the smooth surface aromatic polyamide or Teflon (PTFE) unwoven cloth. It is preferable that a plurality of heaters are used for heating whose temperatures can be freely controlled.

The heating part comprises a preheating part A having pairs of carrying-in rollers 11 and a heat development part B having heaters 15. It is preferable to set the temperature of the preheating part A upperstream of the heat development part B lower than the development temperature (e.g., by 10–50° C.) but higher than the glass transition temperature (Tg) of the support of the heat development photosensitive material 10 not to cause irregular development.

In addition, a guiding pate 16 is placed downstream of the heat development part B, and a slowly cooling part C having carrying-out roller pairs 12 and the guiding plate 16 is placed. It is preferable that the thermal conductivity of the guiding plate is low. It is preferable that cooling is carried out slowly.

Sensitizing pigment A

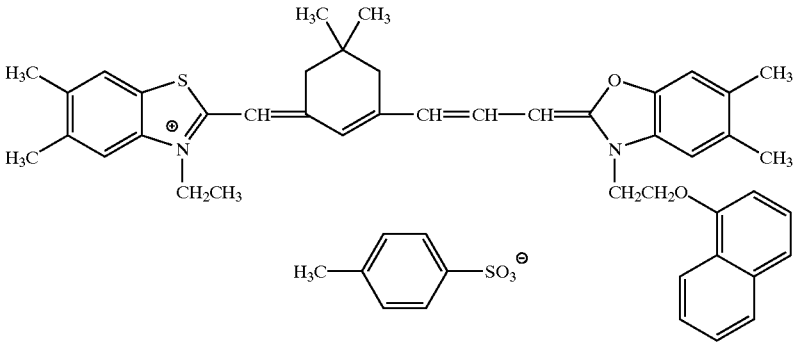

Compound A

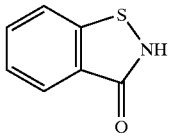

Compound B

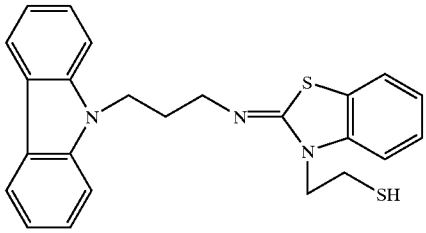

EXAMPLES

The following examples are given only to explain the effectiveness of the present invention, but not to limit the scope of the present invention.

Example 1

Preparation of Silver Halide Emulsion (Emulsion A)

Into 700 ml of water, 11 g of gelatin (containing calcium at 2,700 ppm), 30 mg of potassium bromide, and 10 mg of sodium benzenethiosulfonate were dissolved, the pH of the resultant solution was adjusted to 5.0 at 55° C., followed by the addition of 159 ml of an aqueous solution containing 18.6 g of silver nitrate and a 1M potassium bromide aqueous solution keeping pAg at 7.7 by the control double jet method throughout 6 min 30 sec. A halide aqueous solution containing a 476 ml aqueous solution containing 55.5 g silver nitrate and 1M potassium bromide were added to the resultant mixture keeping pAg at 7.7 by the control double jet method throughout 28 min 30 sec. The pH of the resultant mixture was then lowered to precipitate and desalt, 0.17 g of compound A and 23.7 g of deionized gelatin (containing calcium at 20 ppm or less) were added, followed by adjusting pH and pAg to 5.9 and 8.0, respectively. Obtained particles had an average size of 0.11 mm and a coefficient of variance of projected area of 8%, are cubes having a (100) surface ratio of 93%, and contained gelatin at 5 wt. %.

Silver halide particles thus obtained were heated to 60° C., 76 mmol of sodium benzene sulfonate was added per 1 mol of silver, 154 mmol of sodium thiosulfate was added after 3 min, followed by aging for 100 min.

Then, by keeping the temperature at 40° C., $6.4\times10^{-4}$ mol of sensitizing pigment A and $6.4\times10^{-3}$ mol of compound B were added per 1 mol of silver halide with stirring. Twenty minutes after the addition, the mixture was rapidly cooled to 30° C. to give silver halide emulsion A.

Preparation of Organic Acid Silver Salt Dispersion <Organic Acid Silver Salt A>

4.4 g of arachidic acid, 39.4 g of behenic acid, 700 ml of distilled water, and 70 ml of tert-butanol were mixed. To the obtained mixture, 103 ml of 1N NaOH aqueous solution was added with stirring at 85° C. throughout 60 min. After reaction was continued for additional 240 min, the temperature was lowered to 75° C. 112.5 ml of an aqueous solution containing 19.2 g of silver nitrate was then added throughout 45 sec. After leaving for 20 min, the temperature was lowered to 30° C. Thereafter, solid was removed by vacuum filtration, followed by washing the solid until the electric conductivity of the filtrate becomes 30 mS/cm. Thus obtained solid was treated as wet cake without drying. To the wet cake corresponding to 100 g of dry solid, 5 g of polyvinylalcohol (commercial name "PVA-205") and water were added so that the total weight becomes 500 g. The obtained mixture was predispersed by a homogenizer/mixer.

The predispersed liquid was thrice treated using a disperser (commercial name "Microfluidizer M-110S-EH", Microfulidex International Corp., G10Z interaction chamber used) at a pressure of 1,750 kg/cm$^2$ to give organic acid silver salt dispersion A which contained needle-shaped organic acid silver salt particles having an average short diameter of 0.04 mm, an average long diameter of 0.8 mm, and a coefficient of variance of 30%. The size of the particles was determined using MasterSizerX (Malvern Instruments Ltd.). To obtain a desired dispersion temperature, a coil-type heat exchanger was placed both upstream and downstream of the interaction chamber to control the temperature of a refrigerant.

Preparation of Solid Fine Particle Dispersion Containing 1,1-bis(2-hydroxy-3,5-dimethylphenyl)-3,5,5-trimethylhexane To 20 g of 1,1-bis(2-hydroxy-3,5-dimethylphenyl)-3,5,5-trimethylhexane, 3.0 g of MP polymer MP-203 (Kuraray Co., Ltd.) and 77 ml of water were added, and the resultant mixture was mixed exhaustively to give a slurry, followed by leaving for 3 hr. The obtained slurry and 360 g of zirconia beads having an average diameter of 0.5 mm were then placed in a vessel, followed by dispersion using ¼G Side Glinder Mill (Aimex Co., Ltd.) for 3 hr to give a reductant solid fine particle dispersion, wherein 80% of the particles had a diameter not smaller than 0.3 mm and not larger than 1.0 mm.

Preparation of Solid Fine Particle Dispersion Containing Tribromomethyl Phenyl Sulfone To 30 g of tribromomethyl phenyl sulfone, 0.5 g of hydroxypropylmethylcellulose, 0.5 g of compound C, 88.5 g of water were added, followed by exhaustive mixing to give a slurry, which was then left for 3 hr. A solid fine particle dispersion for preventing overlapping was prepared in a similar way to the reductant solid fine particle dispersion, wherein 80% of the particles had a diameter not smaller than 0.3 mm and not larger than 1.0 mm.

Preparation of Image-forming Layer Coating Liquid

To the organic acid silver salt A, which was obtained as described above, equivalent to 1 mol of silver, the following components were added:

| | |
|---|---|
| Binder, LACSTAR 3307B (Dainippon Ink & Chemicals Co., Ltd., SBR latex, Tg = 17° C.) (as solid) | 470 g |
| 1,1-Bis(2-hydroxy-3,5-dimethylphenyl)-3,5,5-trimethylhexane | 110 g |
| Surfactant, compound W6 | 5 g |
| Tribromomethyl phenyl sulfone | 25 g |
| Sodium benzenesulfonate | 0.25 g |
| Hydrophilic polymer, compound P3 | 46 g |
| 6-iso-Butylphthalazine | 0.12 mol |
| Core-forming agent, e.g., compound C-43 | 1.8 g |
| Compound E | 8.5 g |
| Dye A | 0.62 g |
| Silver halide emulsion A | 0.05 mol (as Ag). |

Water was added to the resultant mixture, and the pH of the mixture was adjusted to 6.5 with 1N sulfuric acid to prepare an coating liquid.

Preparation of Emulsion Surface-protecting Layer Coating Liquid

To 102 g of a polymer latex having a methyl methacrylate/styrene/2-ethylhexyl acrylate/2-hydroxyethylmethacrylate/acrylic acid weight ratio of 59:9:26:5:1 (Tg of copolymer is 54° C.; containing compound F as a film-forming supplementary agent at 15 wt. % percopolymer solid component; solid concentration 44 wt. %), 0.125 g of compound G, 2.5 g of a 30 wt. % solution of carnauba wax (Chukyo Oil & Fat Co., Ltd., Cellosol 524), 2.3 g of polyvinyl alcohol (Kuraray Co., Ltd., PVA-235), and 0.5 g of a matting agent (polystyrene particles, average particle size 7 mm) were added, followed by adding 25 g of a 10 wt. % of compound D to give an coating liquid having a pH of 2.5–3.5.

Compound C

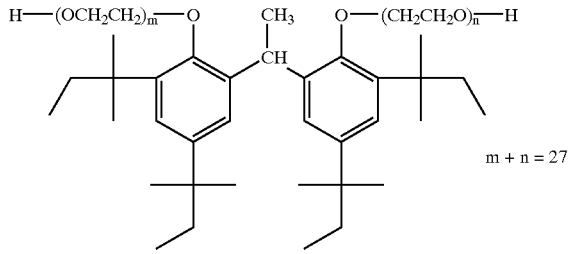

Dye A

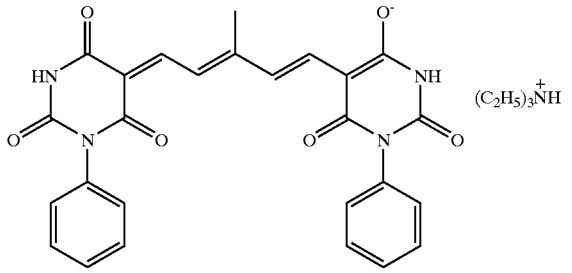

Compound W6

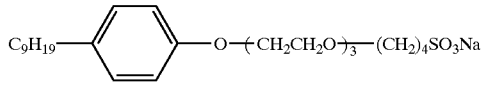

Compound P3

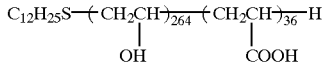

Compound D

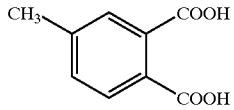

Compound E

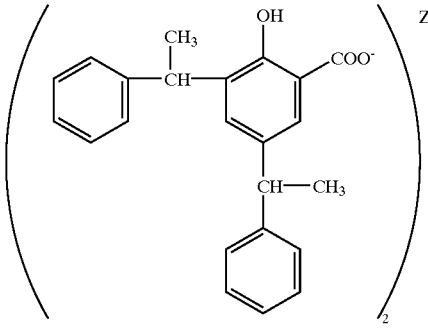

Compound F

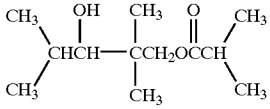

Compound G

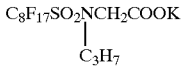

Preparation of Back/undercoating Layer-attached PET Support (1) Support

According to a usual method, PET was synthesized from terephthalic acid and ethylene glycol. The obtained PET had IV (intrinsic viscosity) of 0.66 as measured in phenol/tetrachloroethane (60:40) (w/w) at 25° C. The obtained PET was pelletized, dried at 130° C. for 4 hr, melted at 300° C., extruded from a T-type die, followed by being rapidly cooled to give an unstretched film which has a thickness of 120 mm after thermal fixing.

The obtained film was stretched 3.3 times longitudinally using rollers having different peripheral speeds at 110° C., and then 4.5 times laterally using a tenter at 130° C. The obtained film was then thermally fixed at 240° C. for 20 sec, followed by being relaxed by 4% at the same temperature. The zipper part of the tenter was then slit, both ends of which was near processed, followed by being winded up at a tension of 4.8 kg/cm$^2$ to give a roll having a width of 2.4 m, a length of 3,500 m, and a thickness of 120 mm.

| | |
|---|---|
| (2) Undercoating layer (a) | |
| Polymer latex #2 [Styrene/Butadiene/Hydroxyethyl methacrylate/Divinylbenzene (67:30:2.5:0.5) (wt. %)] | 160 mg/m$^2$ |
| 2,4-Dichloro-6-hydroxy-s-triazine | 4 mg/m$^2$ |
| Matting agent (Polystyrene, average particie size 2.4 mm) | 3 mg/m$^2$ |
| (3) Undercoating layer (b) | |
| Alkali-treated gelatin (containing $Ca^{2+}$ at 30 ppm, jelly strength 230 g) | 50 mg/m$^2$ |
| (4) Electroconductive layer (surface resitivity 109 Ω at 25° C., 25% RH) | |
| Jurymer ET-410 (Nihon Junyaku Co., Ltd.) | 96 mg/m$^2$ |
| Gelatin | 50 mg/m$^2$ |
| Compound A | 0.2 mg/m$^2$ |
| Polyoxyethylenephenylether | 10 mg/m$^2$ |
| Sumitex Resin M-3 (Water-soluble melamine compound, Sumitomo Chem. Co., Ltd.) | 18 mg/m$^2$ |
| Dye A in such an applying amount that opticaldensity at 780 nm becomes 1.0 | |
| $SnO_2$/Sb ((90:10) wt. %, needle-shaped fine particles, long diameter/short diameter ratio 20–30, Ishihara Sangyo Co., Ltd.) | 160 mg/m$^2$ |
| Matting agent [methyl methacrylate/acrylic acid (97:3) wt. % copolymer, average particle size 5 mm] | 7 mg/m$^2$ |
| (5) Back surface-protecting layer | |
| Polymer latex #3 (Tg about 45° C.) methyl methacrylate/styrene/2-ethylhexyl acrylate/2-hydroxyethyl methacrylate/acrylic acid (59:9:26:5:1) (wt. %) copolymer] | 1,000 mg/m$^2$ |
| Polystyrene sulfonate (mol. wt. 1,000–5,000) | 2.6 mg/m$^2$ |
| Lubricant | See Table 23 |
| Sumitex Resin M-3 (Water-soluble melamine compound, Sumitomo Chem. Co., Ltd.) | 218 mg/m$^2$ |
| Surfactant, compound F-3 | 20 mg/m$^2$ |

On one side of a support, undercoating layers (a) and (b) were serially applied, followed by drying each at 180° C. for 4 min. Then, on the opposite surface to the side having undercoating layers (a) and (b), an electroconductive layer and a protecting layer were serially applied, followed by heating at 180° C. for 30 sec to give a PET support having back/undercoating layers. The PET support having back/undercoating layers thus prepared was put in a 30-m-long thermal treatment zone controlled at 150° C., followed by self-weight transportation at a tension of 14 g/cm$^2$ and a speed of 20 m/sec. Thereafter, the obtained support was passed through a zone at 40° C. for 15 sec, followed by winding up at a tension of 10 kg/cm$^2$.

Preparation of Heat-developable Image-recording Material

On the side having undercoating layers (a) and (b) of the PET support having the above-mentioned back/undercoating layers (a) and (b), the above-mentioned image-forming layer was applied, thereon the above-mentioned emulsion surface-protecting layer was applied so that the amount of applied silver becomes 1.6 g/m$^2$ and the amount of solid of polymer latex of the protecting layer becomes 3 g/m$^2$, followed by drying at 65° C. for 3 min to give the samples.

Coefficients of friction and heat development properties of the obtained sample were evaluated according to the following methods:

(1) Coefficient of Friction a) Coefficient of friction between heat development part rollers and surface having image-forming layer of image-recording material The coefficient of friction was determined by determining frictional resistance force ($F_e$) at 120° C. determined by moving the surface having the image-forming layer of the image-recording material with a material have the same surface material and diameter as the roller, and a width of 2 cm under a load of 20 g at a speed of 19 mm/sec, followed by setting the obtained value in the following equation:

$$\text{Coefficient of friction } (\mu_e)=F_e(g)/20(g).$$

b) Coefficient of friction between smooth surface of heat development part and back surface of image-recording material The coefficient of friction was determined by determining frictional resistance force ($F_b$) at 120° C. determined by moving the back side of the image-recording material with a smooth surface material (unwoven cloth) having a size of 2 cm×3.5 cm under a load of 20 g in a method similar to a), followed by setting the obtained value in the equation similar to the equation in a).

(2) Heat Development Property

Transportation and irregular treatment were evaluated using the heat development apparatus shown in FIG. 1, whose roller surface material of the heat development part is silicone rubber and the smooth surface is aromatic polyamide unwoven cloth (or Teflon cloth), by thermally developing by preheating image-recording materials which were exposed to a 90% halftone dot image at 90–100° C. for 5 sec and developing at 120° C. for 20 sec using the following symbols:

Transportability:

○, Passable without problem

×, Unpassable because of jamming

Irregular treatment:

○, No irregular treatment

×, Irregular treatment occurred

Results are shown in Table 23, which shows that the samples according to the present invention did not cause treatment troubles and had good transportability and photographic properties.

TABLE 23

| SAMPLE NO. | LUBRICANT MATERIAL | LUBRICANT COATING AMOUNT (mg/m²) | HEAT DEVELOPMENT PART SMOOTH SURFACE MATERIAL | COEFFICIENT OF FRICTION μe | COEFFICIENT OF FRICTION μb | RATIO OF COEFFICIENTS OF FRICTION (μe/μb) | UNEVEN TREATMENT | TRANSPORT-ABILITY |
|---|---|---|---|---|---|---|---|---|
| 1 | CELLOZOL524 | 25 | aromatic polyamide | 2.8 | 1.95 | 1.4 | — | x |
| 2(INVENTION) | CELLOZOL524 | 50 | aromatic polyamide | 2.8 | 0.90 | 3.1 | ○ | ○ |
| 3(INVENTION) | CELLOZOL534 | 75 | aromatic polyamide | 2.8 | 0.75 | 3.7 | ○ | ○ |
| 4(INVENTION) | CELLOZOL534 | 25 | PTTE | 2.8 | 0.25 | 11.2 | ○ | ○ |
| 5(INVENTION) | CELLOZOL524 | 50 | PTFE | 2.8 | 0.15 | 18.7 | ○ | ○ |
| 6(INVENTION) | CELLOZOL524 | 75 | PTFE | 2.8 | 0.10 | 28.0 | ○ | ○ |

Example 2

Image-recording materials in which a polymer latex of back layers of samples no. 1–6 was substituted for Chemipearl S120 (Mitsui Chem. Co., Ltd., olefinresin, Tg about 80° C.) in Example 1, was prepared and evaluated resulting that ratios of coefficients of friction ($m_e/m_b$) were all 2.0 or more (2.0–3.0), did not cause irregular treatment, and had good transportability and photographic properties.

Example 3

(1) Preparation of Support (Base)

PET having IV (intrinsic viscosity) of 0.66 (measured in phenol/tetrachloroethane=6/4 (weight ratio) at 25° C.) was obtained by using terephthalic acid and ethylene glycol in a conventional manner. This was pelletized, dried at 130° C. for 4 hours, melted at 300° C., extruded from a T-die, and quenched to form an unstretched film having a thickness of 120 μm after thermal fixation.

This film was stretched along the longitudinal direction by 3.3 times using rollers of different peripheral speeds, and then stretched along the transverse direction by 4.5 times using a tenter. The temperatures used for these operations were 100° C. and 130° C., respectively. Then, the film was subjected to thermal fixation at 240° C. for 20 seconds, and relaxed by 4% along the transverse direction at the same temperature. Thereafter, the chuck of the tenter was released, the both edges of the film were knurled, and the film was rolled at 4.8 kg/cm². Thus, a roll of a film having a width of 2.4 m, length of 3500 m, and thickness of 120 μm was obtained.

| (2) Undercoat layer (a) | |
|---|---|
| Polymer latex V-5<br>core shell type latex comprising 90% by weight of core and 10% by weight of shell, average molecular weight; 38000, core: vinylidene chloride/methyl acrylate/methyl methacrylate/acrylonitrile/acrylic acid = 93/3/3/0.9/0.1 (% by weight), shell; vinylidene chloride/methyl acrylate/methyl methacrylate/acrylonitrile/acrylic acid = 88/3/3/3/3 (% by weight)) | 3.0 g/m² as solid content |
| 2,4-Dichloro-6-hydroxy-s-triazine | 23 mg/m2 |
| Matting agent (polystyrene, average diameter; 2.4 μm) | 1.5 mg/m² |
| Undercoat layer (b) | |
| Alkali treated gelatin<br>($Ca^{++}$ content; 30 ppm, jelly strength; 230 g) | 50 mg/m² |

(3) Electroconductive Layer (Surface Resistivity at 25° C. and 25% RH; $10^9\Omega$)

Prepared in the same manner as (4) conductive layer of Example 1.

(4) Protective Layer (Back Face)

Prepared in the same manner as sample Nos. 1 to 6 in Example 1 except that the slipping agent of Example 1 was substituted by Himicron G-110 produced by Chukyo Oil & Fat Co., Ltd.

(5) Preparation of Support

Undercoat layer (a) and Undercoat layer (b) were successively applied on both sides of the support (base), and each dried at 180° C. for 4 minutes. Then, an electroconductive layer and a protective layer are successively applied to one side after applying Undercoat layer (a) and Undercoat layer (b), and each dried at 180° C. for 4 minutes to prepare PET Supports 1 to 6 having back layers and undercoat layers. The dry thickness of Undercoat layer (a) was 2.0 μm (for one side).

PET supports 1–6 having back/undercoating layers thus prepared were put in a 30-m-long thermal treatment zone controlled at 150° C., followed by self-weight transportation at a tension of 14 kg/cm² and a speed of 20 m/min. The obtained supports were then put in a zone controlled at 40° C. for 15 sec, followed by winding up at a tension of 10 kg/cm².

On the side having undercoating layers (a) and (b) of the thermally treated PET supports 1–6, an image-forming layer was applied according to Example 1, thereon a protecting layer was applied so that the amount of applied silver becomes 1.6 g/m² and the solid of applied polymer latex of the protecting layer becomes 3 g/m², followed by drying at 65° C. for 3 min to give samples no. 7–12, which were then evaluated by the methods similar to Example 1. Result of the evaluation is shown in Table 24.

Table 24 shows that the samples according to the present invention did not cause irregular treatment and had good transportability and photographic properties.

TABLE 24

| SAMPLE NO. | LUBRICANT MATERIAL | LUBRICANT COATING AMOUNT ($mg/m^2$) | HEAT DEVELOPMENT PART SMOOTH SURFACE MATERIAL | COEFFICIENT OF FRICTION $\mu e$ | COEFFICIENT OF FRICTION $\mu b$ | RATIO OF COEFFICIENTS OF FRICTION ($\mu e/\mu b$) | UNEVEN TREATMENT | TRANSPORT-ABILITY |
|---|---|---|---|---|---|---|---|---|
| 7 | Himicron G-110 | 25 | aromatic polyamide | 2.85 | 2.00 | 1.4 | — | x |
| 8(INVENTION) | Himicron G-110 | 50 | aromatic polyamide | 2.85 | 0.88 | 3.2 | ○ | ○ |
| 9(INVENTION) | Himicron G-110 | 75 | aromatic polyamide | 2.85 | 0.70 | 4.1 | ○ | ○ |
| 10(INVENTION) | Himicron G-110 | 25 | PTTE | 2.85 | 0.27 | 10.6 | ○ | ○ |
| 11(INVENTION) | Himicron G-110 | 50 | PTFE | 2.85 | 0.14 | 20.4 | ○ | ○ |
| 12(INVENTION) | Himicron G-110 | 75 | PTFE | 2.85 | 0.11 | 25.9 | ○ | ○ |

What is claimed is:

1. A method of developing a heat-developable image-recording material, comprising a support, at least one image-forming layer on the support, and at least one protecting layer on the image-forming layer, comprising the step of:

placing said image-recording material in a heat development apparatus, comprising:

a roller coming into a driving contact with a surface of said material on the side having the image-forming layer, and a smooth surface coming into a sliding contact for transport with a surface of said material opposite to said surface on the side having said image-forming layer, wherein at the temperature where said development is carried out, the ratio is 3.1 to 28.0 of the coefficient of friction, $\mu e$, between said surface on the side having said image-forming layer and a surface of said roller of said heat development apparatus, to the coefficient of friction, $\mu b$, between said surface of said material opposite to said surface on the side having said image-forming layer and said smooth surface of said heat development apparatus, wherein the coefficient of friction, $\mu b$, is within the range of 0.1 to 0.9;

wherein said at least one image forming layer comprises an organic silver salt, a reducing agent and a photosensitive halide.

* * * * *